US007541896B2

(12) United States Patent
Fukunaga

(10) Patent No.: US 7,541,896 B2
(45) Date of Patent: Jun. 2, 2009

(54) STACKED RESONATOR AND FILTER

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 141 days.

(21) Appl. No.: 11/712,514

(22) Filed: Mar. 1, 2007

(65) Prior Publication Data

US 2007/0205851 A1 Sep. 6, 2007

(30) Foreign Application Priority Data

Mar. 3, 2006 (JP) ..... 2006-058019

(51) Int. Cl.
*H01P 1/203* (2006.01)
*H01P 7/08* (2006.01)

(52) U.S. Cl. ..... 333/204; 333/206; 333/219

(58) Field of Classification Search ..... 333/202, 333/204, 206, 219; 310/358, 359; 361/321.2
See application file for complete search history.

(56) References Cited

U.S. PATENT DOCUMENTS 5,892,415 A * 4/1999 Okamura ..... 333/175

FOREIGN PATENT DOCUMENTS

JP A-2002-190413 7/2002
JP A-2003-007537 1/2003
JP A-2005-045447 2/2005
JP A-2005-080248 3/2005

* cited by examiner

*Primary Examiner*—Benny Lee
*Assistant Examiner*—Kimberly E Glenn
(74) *Attorney, Agent, or Firm*—Oliff & Berridge, PLC

(57) ABSTRACT

A stacked resonator and a filter are provided which are capable of achieving miniaturization and minimum loss, and also capable of transmitting a balanced signal with superior balance characteristics. There are provided a pair of quarter-wave resonators which are interdigital-coupled to each other. One quarter-wave resonator is constructed of a plurality of conductor lines which are stacked and arranged so as to establish a comb-line coupling. By the stacked arrangement so as to establish a comb-line coupling of the plurality of conductor lines, the conductor thickness of this quarter-wave resonator can be increased virtually thereby reducing the conductor loss. Similarly, the other quarter-wave resonator is constructed of a plurality of conductor lines stacked and arranged so as to establish a comb-line coupling, and hence the conductor thickness of this quarter-wave resonator can be increased virtually thereby reducing the conductor loss.

9 Claims, 14 Drawing Sheets

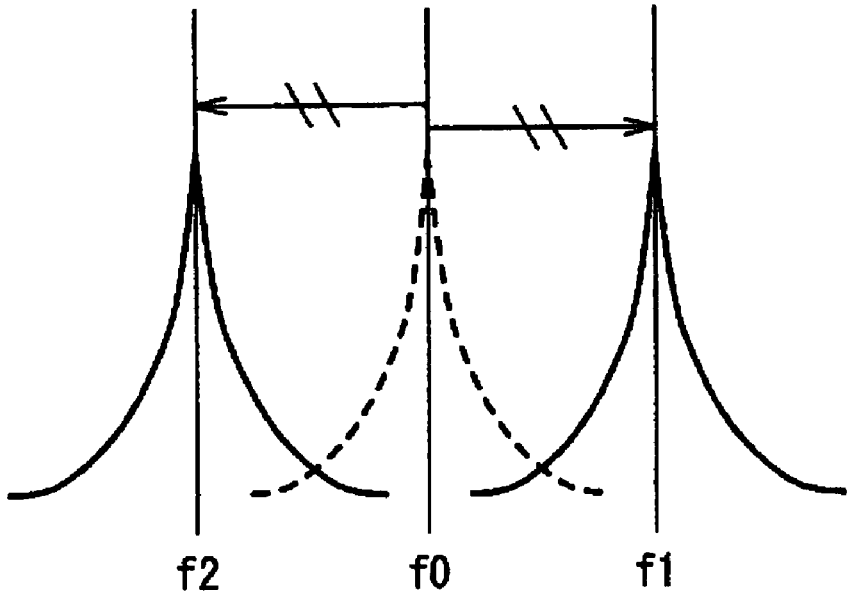
FIG. 10
FIG. 11A
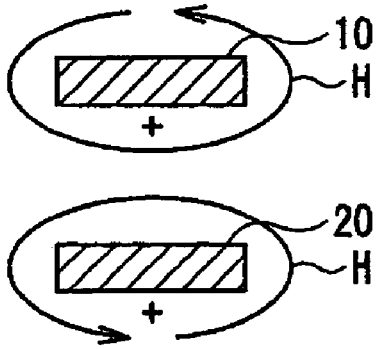
FIG. 11B
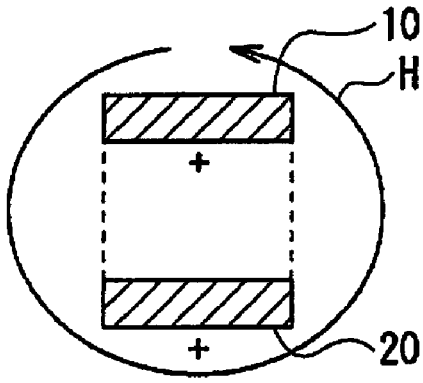

STACKED RESONATOR AND FILTER

BACKGROUND OF THE INVENTION

1. Field of the Invention

The present invention relates to a stacked resonator with a plurality of conductors stacking one upon another, and a filter constructed by using the stacked resonator.

2. Description of the Related Art

For example, demanding requirements of miniaturization and minimum loss are placed on filters used in radio communication equipments such as cellular phones. Consequently, the same is true for resonators constituting the filters. As a filter having a balanced terminal, there is known for example a band pass filter of unbalanced input/balanced output type. As such a filter, there is one using a balun. The balun is used to perform mutual conversion between an unbalanced signal and a balanced signal. In a line for transmitting an unbalanced signal, a signal is transmitted by the potential of a signal line with respect to a ground potential. In a line for transmitting a balanced signal, a signal is transmitted by the potential difference between a pair of signal lines. A balanced signal is generally considered as being superior in balance characteristics when the phases of signals transmitted between a pair of signal lines are different from each other by 180 degrees, and are of substantially the same amplitude.

FIG. 23 illustrates a general structure of a balun. This balun has a half-wave (μ/2) resonator 201, and first and second quarter-wave resonators 202 and 203. Both ends of the half-wave resonator 201 are open ends, and an unbalanced input terminal 211 is connected to one open end. The short-circuit ends of the first and second quarter-wave resonators 202 and 203 are arranged so as to oppose to the half-wave resonator 201 so that they are opposed to the open ends of the half-wave resonator 201, respectively. Balanced output terminals 212 and 213 are connected to the open ends of the first and second quarter-wave resonators 202 and 203, respectively, thereby forming a pair of balanced output terminals.

As a balun having this structure, there are laminate type balun transformers as described in Japanese Unexamined Patent Publications No. 2002-190413 and No. 2003-007537. Both aim at miniaturization due to a laminate structure which can be obtained by forming each resonator with a spiral-like conductor line pattern, and forming the conductor line pattern on a plurality of dielectric substrates. Japanese Unexamined Patent Publication No. 2005-045447 and No. 2005-080248 describe laminate type band pass filters using a half-wave resonator, as a balanced output type band pass filter.

SUMMARY OF THE INVENTION

Nevertheless, in the laminate type balun transformers described in the above-mentioned Publications No. 2002-190413 and No. 2003-007537, the entire dimension is limited by the dimension of the half-wave resonator (the dimension of the half-wave of the operating frequency), making it difficult to achieve miniaturization. These publications also disclose that the respective resonators are formed in spiral structure. However, due to unnecessary coupling between the lines, and departure from an ideal state of physical arrangement balance, the amplitude balance and the phase balance at the time of balanced output may collapse, failing to obtain the desired characteristics. Similarly, in the laminate type band pass filters described in the above-mentioned Publications No. 2005-045447 and No. 2005-080248, the half-wave resonator is basically used, and hence the entire dimension is limited by the dimension of the half-wave resonator, making it difficult to achieve miniaturization.

It is desirable to provide a stacked resonator and a filter which are capable of achieving miniaturization and minimum loss. It is also desirable to provide a stacked resonator and a filter which are capable of transmitting a balanced signal with superior balance characteristics.

The stacked resonator of an embodiment of the invention includes a pair of quarter-wave resonators which are interdigital-coupled to each other. Each of the pair of quarter-wave resonators is constructed of a plurality of conductors which are stacked and arranged so as to establish a comb-line coupling.

In the stacked resonator according to an embodiment of the present invention, the expression "a pair of quarter-wave resonators which are interdigital-coupled to each other" means resonators electromagnetically coupled to each other by arranging so that the open end of one quarter-wave resonator and the short-circuit end of the other quarter-wave resonator are opposed to each other, and the short-circuit end of one the quarter-waver resonator and the open end of the other the quarter-wave resonator are opposed to each other. The expression "a plurality of conductor lines which are stacked and arranged so as to establish a comb-line coupling" means a group of conductor lines arranged so that their respective short-circuit ends are opposed to each other, and their respective open ends are opposed to each other.

Preferably, the pair of quarter-wave resonators have a first resonance mode in which a resonance at a first resonance frequency $f_1$ higher than a resonance frequency $f_0$ is produced, and a second resonance mode in which a resonance at a second resonance frequency $f_2$ lower than the resonance frequency $f_0$ is produced, where $f_0$ is a resonance frequency in an individual resonator of the pair of quarter-wave resonators when establishing no interdigital-coupling, and an operating frequency is the second resonance frequency $f_2$.

In the stacked resonator of an embodiment the invention, each of the pair of quarter-wave resonators is constructed of the plurality of conductor lines, and these conductor lines are stacked and arranged so as to establish a comb-line coupling. This virtually increases the conductor thickness of each quarter-wave resonator, thereby reducing the conductor loss.

Additionally, the interdigital-coupling of the pair of quarter-wave resonators facilitates miniaturization. When the pair of quarter-wave resonators are of interdigital type and strongly coupled to each other, as a result, with respect to a resonance frequency $f_0$ in each of the quarter-wave resonators when establishing no interdigital-coupling (i.e., the resonance frequency determined by the physical length of a quarter-wave), there appear two resonance modes of a first resonance mode in which a resonance at a first resonance frequency $f_1$ higher than the resonance frequency $f_0$ produced, and a second resonance mode in which a resonance at a second resonance frequency $f_2$ lower than the first resonance frequency $f_0$ is produced, and the resonance frequency is then separated into two. In this case, by setting, as an operating frequency as a resonator, the second resonance frequency $f_2$ lower than the resonance frequency $f_0$ corresponding to the physical length, miniaturization can be facilitated than setting the operating frequency to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band. In the second resonance mode which is a lower frequency, a current i flows in the same direction to each resonator of each conductor group, and hence the conductor thickness increases artificially, thereby reducing the conductor loss.

The stacked resonator may be further provided with a pair of balanced terminals, one terminal being connected to one of the pair of quarter-wave resonators, the other terminal being connected to the other of the pair of quarter-wave resonators.

Preferably, the pair of quarter-wave resonators have, as a whole, a structure of rotation symmetry having an axis of rotation symmetry, and the pair of balanced terminals are connected, respectively, to the pair of quarter-wave resonators at such positions as to be mutually rotation-symmetric with respect to the axis of rotation symmetry. This configuration enables a balanced signal to be transmitted with superior balance characteristics.

A plurality of sets of a pair of quarter-wave resonators may be provided which are stacked and arranged in a direction which is same as a stacking direction of the conductor lines in each quarter-wave resonator so as to oppose to each other, thereby establishing a single stack.

In this configuration, all of the individual quarter-wave resonators in the plurality sets of the pair of quarter-wave resonators are stacked and arranged in the same direction, thus facilitating area saving than the case, for example, where a plurality of sets of a pair of quarter-wave resonators are arranged side by side in a plane direction. Further, the stacked arrangement of the individual quarter-wave resonators in the same direction facilitates to enhance the coupling between the pair of quarter-wave resonators, thus enabling a broadband balanced signal to be transmitted with superior balance characteristics when the pair of balanced terminals are connected to each other.

In the configuration provided with a plurality of sets of a pair of quarter-wave resonators, there may be further provided with at least a pair of balanced terminals, and the plurality of sets of a pair of quarter-wave resonators may have, as a whole, a structure of rotation symmetry having an axis of rotation symmetry, and one terminal and the other terminal of the pair of balanced terminals may be connected, respectively, to the plurality of sets of the pair of quarter-wave resonators at such positions as to be mutually rotation-symmetric with respect to the axis of rotation symmetry. This configuration enables a balanced signal to be transmitted with superior balance characteristics.

Alternatively, in the plurality of sets of the pair of quarter-wave resonators, the number of conductor lines constituting each quarter-wave resonator may be different in part.

The filter of another embodiment of the invention includes: a first resonator having at least a pair of quarter-wave resonators which are interdigital-coupled to each other; a pair of balanced terminals connected to the first resonator; and a second resonator having at least another pair of quarter-wave resonators which are interdigital-coupled to each other, the second resonator being electromagnetically coupled to the first resonator thereby establishing a single stack.

In the filter according to the invention, the expression "a pair of quarter-wave resonators which are interdigital-coupled to each other" means resonators electromagnetically coupled to each other by arranging so that the open end of one quarter-wave resonator and the short-circuit end of the other quarter-wave resonator are opposed to each other, and the short-circuit end of one the quarter-waver resonator and the open end of the other the pair of quarter-wave resonator are opposed to each other. The expression "a plurality of conductor lines which are stacked and arranged so as to establish a comb-line coupling" means a group of conductor lines arranged so that their respective short-circuit ends are opposed to each other, and their respective open ends are opposed to each other.

Preferably, each pair of the quarter-wave resonators in the first resonator have a first resonance mode in which a resonance at a first resonance frequency $f_1$ higher than a resonance frequency $f_0$ is produced, and a second resonance mode in which a resonance at a second resonance frequency $f_2$ lower than the resonance frequency $f_0$ is produced, where $f_0$ is a resonance frequency in an individual resonator of the pair of quarter-wave resonators when establishing no interdigital-coupling. The first resonator and the second resonator are electromagnetically coupled to each other at the second resonance frequency $f_2$.

In the filter according to the invention, each of the quarter-wave resonators in the first resonator and the second resonator is constructed of the plurality of conductor lines, and these conductor lines are stacked and arranged so as to establish a comb-line coupling. This virtually increases the conductor thickness of each quarter-wave resonator, thereby reducing the conductor loss.

Additionally, each of the first resonator and the second resonator is constructed of the pair of quarter-wave resonators which are interdigital-coupled to each other, thereby facilitating miniaturization. Here, consider that case where the pair of quarter-wave resonators are of interdigital type and strongly coupled to each other. As a result, with respect to a resonance frequency $f_0$ in each of the quarter wave resonators when establishing no interdigital-coupling (i.e., the resonance frequency determined by the physical length of a quarter-wave), there appear two resonance modes of a first resonance mode in which a resonance at a first resonance frequency $f_1$ higher than the resonance frequency $f_0$ is produced, and a second resonance mode in which a resonance at a second resonance frequency $f_2$ lower than the first resonance frequency $f_1$ is produced, and the resonance frequency is then separated into two. In this case, by setting, as a passing frequency (operating frequency) as a filter, the second resonance frequency $f_2$ lower than the resonance frequency $f_0$ corresponding to the physical length, miniaturization can be facilitated than setting the operating frequency to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band. Further, the second resonance mode in which produced is a resonance at the second resonance frequency $f_2$ of a lower frequency is a driven mode that becomes the negative phase by the pair of quarter wavelength resonators, thereby achieving superior balance characteristics. In the second resonance mode which is a lower frequency, a current i flows in the same direction to each resonator of each conductor group, and hence the conductor thickness increases artificially, thereby reducing the conductor loss.

Preferably, the first resonator has, as a whole, a structure of rotation symmetry having an axis of rotation symmetry, and one terminal and the other terminal of the pair of balanced terminals are connected, respectively, to the first resonator at such positions as to be mutually rotation-symmetric with respect to the axis of rotation symmetry. This configuration enables a balanced signal to be transmitted with superior balance characteristics.

The first resonator and the second resonator may be stacked and arranged in a direction which is same as a stacking direction of the conductor lines in each quarter-wave resonator so as to oppose to each other.

In this configuration, all of the individual quarter-wave resonators constituting the first resonator and the second resonator are stacked and arranged in the same direction, thus facilitating area saving than the case, for example, where a plurality of sets of a pair of quarter-wave resonators are arranged side by side in a plane direction.

There may be further provided with a third resonator arranged at a middle stage between the first resonator and the second resonator, the third resonator having at least another pair of quarter-wave resonators which are interdigital-coupled to each other. Each of the pair of quarter-wave resonators in the third resonator may also be constructed of a plurality of conductor lines stacked and arranged so as to establish a comb-line coupling.

In accordance with the stacked resonator of the invention, each of the pair of quarter-wave resonator is constructed of the plurality of conductor lines, and these conductor lines are stacked and arranged so as to establish a comb-line coupling. This virtually increases the conductor thickness of each quarter-wave resonator, thereby reducing the conductor loss. The interdigital-coupling of the pair of quarter-wave resonators facilitates miniaturization. Thus, miniaturization and minimum loss can be achieved. When the pair of quarter-wave resonators have, as a whole, the structure of rotation symmetry having the axis of rotation symmetry, and the pair of balanced terminals are connected to the pair of quarter-wave resonators at such positions as to be mutually rotation-symmetric with respect to the axis of rotation symmetry, a balanced signal can be transmitted with superior balance characteristics.

In accordance with the filter of the invention, each of the quarter-wave resonators in the first resonator and the second resonator is constructed of the plurality of conductor lines, and these conductor lines are stacked and arranged so as to establish a comb-line coupling. This virtually increases the conductor thickness of each quarter-wave resonator, thereby reducing the conductor loss. Additionally, each of the first resonator and the second resonator is constructed of the pair of quarter-wave resonators which are interdigital-coupled to each other, thereby facilitating miniaturization. Thus, miniaturization and minimum loss can be achieved. When the first resonator has, as a whole, the structure of rotation symmetry having the axis of rotation symmetry, and one terminal and the other terminal of the pair of balanced terminals are connected to the first resonator at such positions as to be mutually rotation-symmetric with respect to the axis of rotation symmetry, a balanced signal can be transmitted with superior balance characteristics.

Other and further objects, features and advantages of the invention will appear more fully from the following description.

BRIEF DESCRIPTION OF THE DRAWINGS

FIG. 10 is an explanatory drawing illustrating a distribution state of resonance frequency in the pair of quarter-wave resonators which are interdigital-coupled to each other;

FIGS. 11A and 11B are a first explanatory drawing and a second explanatory drawing each illustrating a field distribution in the pair of quarter-wave resonators which are interdigital-coupled to each other;

DESCRIPTION OF THE PREFERRED EMBODIMENTS

Preferred embodiments of the present invention will now be described in detail with reference to the accompanying drawings.

First Preferred Embodiment

Figure 1:
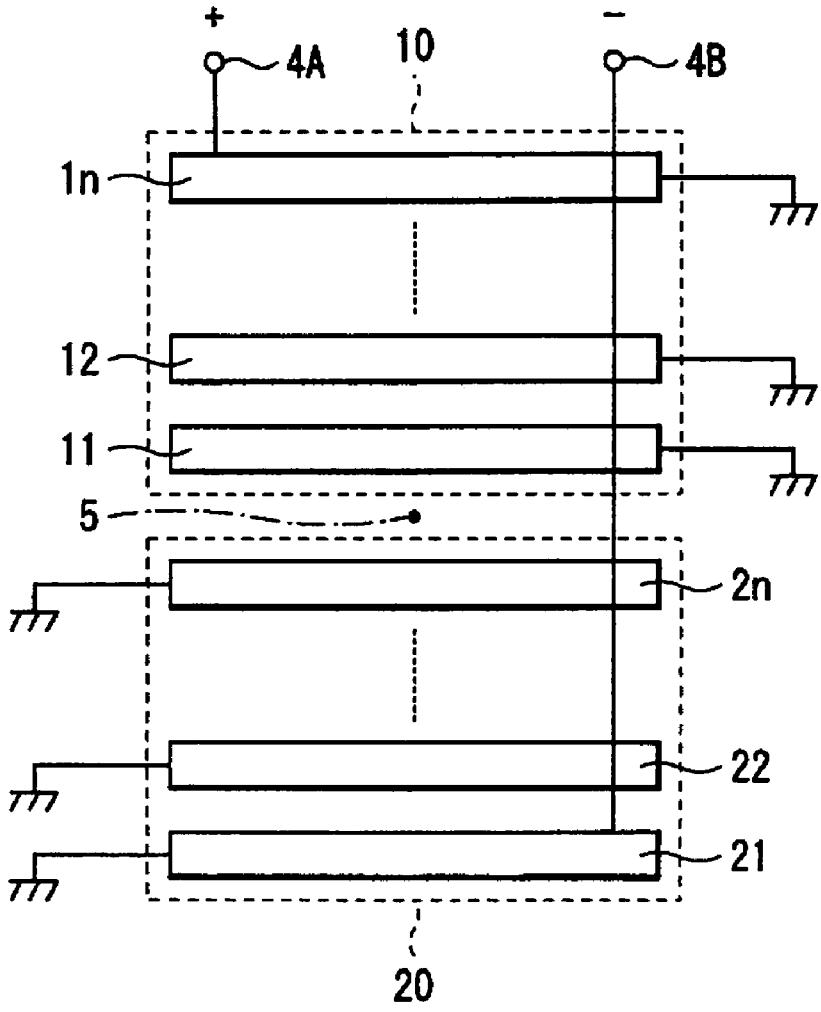
FIG. 1 is a block diagram illustrating a basic configuration of a stacked resonator according to a first preferred embodiment of the present invention.
Figure 2:
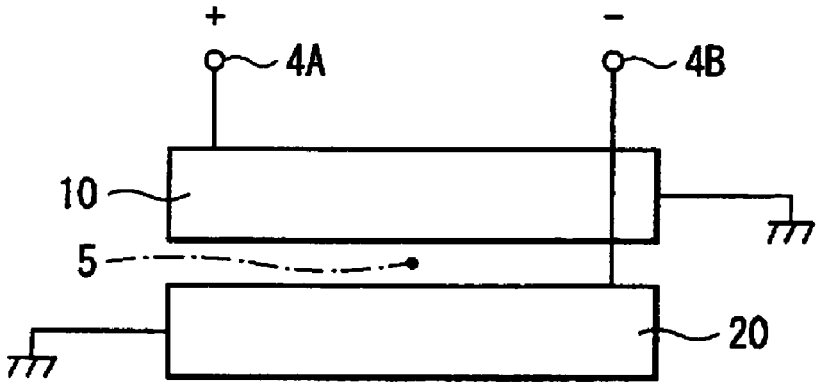
FIG. 2 is a block diagram illustrating an equivalent configuration of the stacked resonator in the first preferred embodiment.

First, a stacked resonator according to a first preferred embodiment of the present invention will be described. FIG. 1 illustrates a basic configuration of the stacked resonator of the present embodiment. FIG. 2 illustrates an equivalent configuration of the stacked resonator in the present embodiment. This stacked resonator can be used as a component constituting, for example, an antenna or a filter. This stacked resonator has a pair of quarter-wave resonators 10 and 20 which are interdigital-coupled to each other, and a pair of balanced terminals 4A and 4B which are connected to the resonators 10 and 20, respectively.

One quarter-wave resonator 10 is constructed of a plurality of conductor lines 11, 12, . . . 1*n* which are stacked and arranged so as to establish a comb-line coupling. The plurality of conductor lines 11, 12, . . . 1*n* are vertically adjacent to each other, and stacked and arranged with predetermined spaced intervals, and they are also arranged so that their respective short-circuit ends are opposed to each other and their respective open ends are opposed to each other, thereby establishing the comb-line coupling. Similarly, the other quarter-wave resonator 20 is constructed of other plurality of conductor lines 21, 22, . . . 2*n* which are vertically adjacent to each other, and stacked and arranged with predetermined spaced intervals, so as to establish comb-line coupling. In the other quarter-wave resonator 20, the ends of the plurality of conductor lines 21, 22, . . . 2*n* which are opposed to the open ends of the plurality of conductor lines 11, 12, . . . 1*n* in one quarter-wave resonator 10, respectively, are used as the short-circuit ends, and the ends opposed to the short-circuit ends of the plurality of conductor lines 11, 12, . . . 1*n* are used as the open ends, respectively. Thus, the plurality of conductor lines 21, 22, . . . 2*n* can symmetrically be comb-line coupled to the plurality of conductor lines 11, 12, . . . 1*n* in one the quarter-wave resonator 10.

Here, when the plurality of conductor lines 11, 12, . . . 1*n* are regarded in whole as one resonator, and the plurality of conductor lines 21, 22, . . . 2*n* are regarded in whole as another resonator, it can be considered, as shown in FIG. 2, as a structure where the pair of quarter-wave resonators 10 and 20 are interdigital-coupled to each other, each using one end thereof as the open end, and the other end thereof as the short-circuit end. As used herein, the pair of resonators which are interdigital-coupled each other means resonators which are electromagnetically coupled to each other by arranging so that the open end of one resonator is opposed to the short-circuit end of the other resonator, and the short-circuit end of the one resonator is opposed to the open end of the other resonator.

The pair of quarter-wave resonators 10 and 20 have, as a whole, a structure of rotation symmetry having an axis of rotation symmetry 5. In order to obtain the structure of rotation symmetry, it is desirable that one plurality of conductor lines 11, 12, . . . 1*n* and the other plurality of conductor lines 21, 22, . . . 2*n* be constructed of the same number of conductor lines, and both have the same line intervals. One balanced terminal 4A is connected to one quarter-wave resonator 10 of the pair of quarter-wave resonators 10 and 20, and the other balanced terminal 4B is connected to the other quarter-wave resonator 20. Preferably, the pair of balanced terminals 4A and 4B are connected to the pair of quarter-wave resonators 10 and 20 at such positions as to be mutually rotation symmetry with respect to the axis of rotation symmetry 5. This leads to superior balance characteristics. Alternatively, a plurality of sets of the pair of balanced terminals 4A and 4B may be provided. Also in this case, it is desirable that one balanced terminals 4A be connected to one quarter-wave resonator 10 and the other balanced terminal 4B be connected to the other quarter-wave resonator 20 at such positions as to be mutually rotation symmetry with respect to the axis of rotation symmetry 5.

The pair of quarter-wave resonators 10 and 20 are strongly interdigital-coupled as will be described later, and hence have a first resonance mode in which a resonance at a first resonance frequency $f_1$ is produced, and a second resonance mode in which a resonance at a second resonance frequency $f_2$ lower than a resonance frequency $f_1$ is produced. More specifically, they have the first resonance frequency $f_1$ higher than a resonance frequency $f_0$, and the second resonance frequency $f_2$ lower than the resonance frequency $f_0$, wherein $f_0$ is a resonance frequency in an individual resonator of the pair of quarter-wave resonators 10 and 20 when establishing no interdigital-coupling. It is configured so that the operating frequency becomes the second resonance frequency $f_2$.

The main components of the stacked resonator are constructed of a TEM (transverse electro magnetic) line. For example, the TEM line can be constructed of a conductor pattern such as a strip line or a through conductor formed in the inside of a dielectric substrate. The term "TEM line" means a transmission line for transmitting an electromagnetic wave (a TEM wave) in which both of an electric field and a magnetic field exist only within a cross section perpendicular to a direction of travel of the electromagnetic wave.

Figure 3:
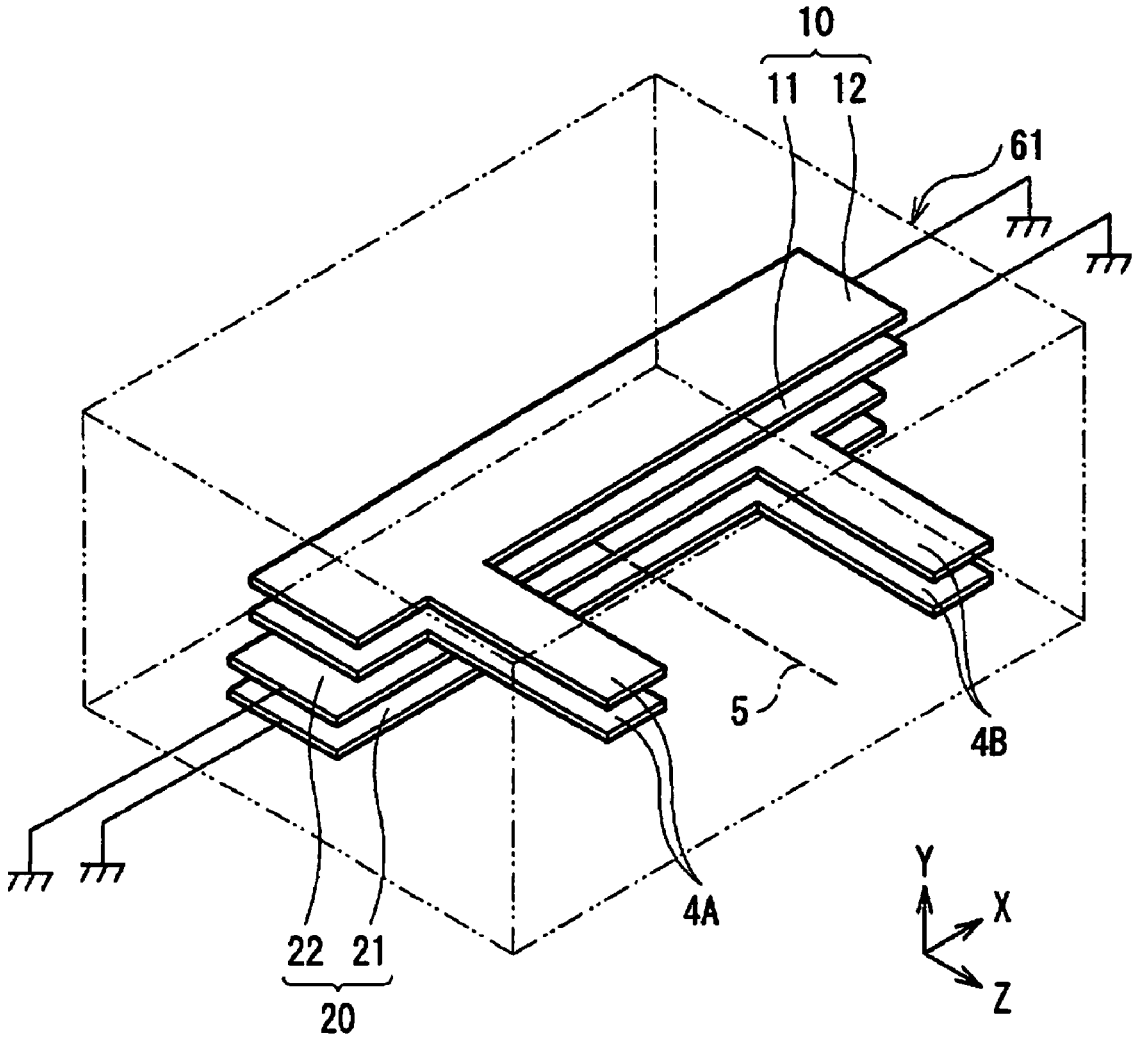
FIG. 3 is a perspective view illustrating a specific example of the configuration of the stacked resonator in the first preferred embodiment.

FIG. 3 illustrates a specific example of the configuration of the above-mentioned stacked resonator. This example is provided with a dielectric substrate 61 constructed of a dielectric material, and the dielectric substrate 61 has a multilayer structure. In this example, a pair of quarter-wave resonators 10 and 20 are provided wherein one quarter-wave resonator 10 is constructed of two conductor lines 11 and 12, and the other quarter-wave resonator 20 is constructed of two conductor lines 21 and 22. Two sets of a pair of balanced terminals 4A and 4B can be formed, where two sets of one the balanced terminals 4A is connected to one the quarter-wave resonator 10, and two sets of the other the balanced terminals 4B is connected to the other the quarter-wave resonator 20. A line pattern (a strip line) of the conductor is formed in the inside of the dielectric substrate 61, and this line pattern is used to form the pair of quarter-wave resonators 10 and 20, and the two sets of the pair of balanced terminals 4A and 4B. To obtain this structure, for example, a laminate structure may be formed by the steps of: preparing a plurality of sheet-shaped dielectric substrates; forming individual line portions on the sheet-shaped dielectric substrates by using the line pattern of a conductor; and laminating the sheet-shaped dielectric substrates.

Although not illustrated, the dielectric substrate 61 is provided with a ground layer for grounding the short-circuit ends of the pair of quarter-wave resonators 10 and 20. For example, the ground layer can be disposed on the upper surface, the bottom surface, or the inside of the dielectric substrate 61. In this case, for example, on the side surface of the dielectric substrate 61 where the respective conductor lines extend, the surfaces of the short-circuit ends of the respective conductor lines may be exposed, and a connecting conductor pattern for connecting to the ground layer may be disposed on the side surface of the part thus exposed, so that the individual short-circuit ends of the respective conductor lines are caused to be conducting to the ground layer with the connecting conductor pattern interposed therebetween. Alternatively, a through-hole may be formed between each of the short-circuit ends of the respective conductor lines and the ground layer, so that the conduction between the two can be established by the through-hole.

The operation of the stacked resonator according to the first preferred embodiment will be described below.

In this stacked resonator, the pair of quarter-wave resonators 10 and 20 are provided wherein one quarter-wave resonator 10 is constructed of a plurality of conductor lines 11, 12, . . . 1*n* and the other resonator 20 is constructed of conductor lines 21, 22, . . . 2*n*. The plurality of conductor lines 11, 12, . . . 1*n* and conductor lines 21, 22, . . . 2*n* are stacked and arranged so as to establish a comb-line coupling. This virtually increases the conductor thickness of the pair of quarter-wave resonators 10 and 20, thereby reducing the conductor loss. This principle will be described below.

Figure 4:
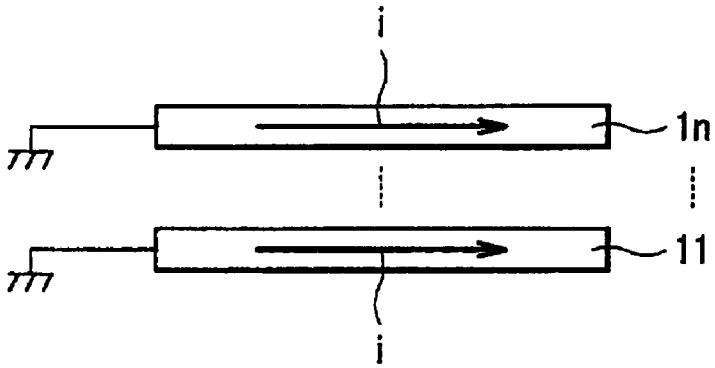
FIG. 4 is an explanatory drawing schematically illustrating the direction in which a current flows in comb-line coupled resonators.
Figure 5A:
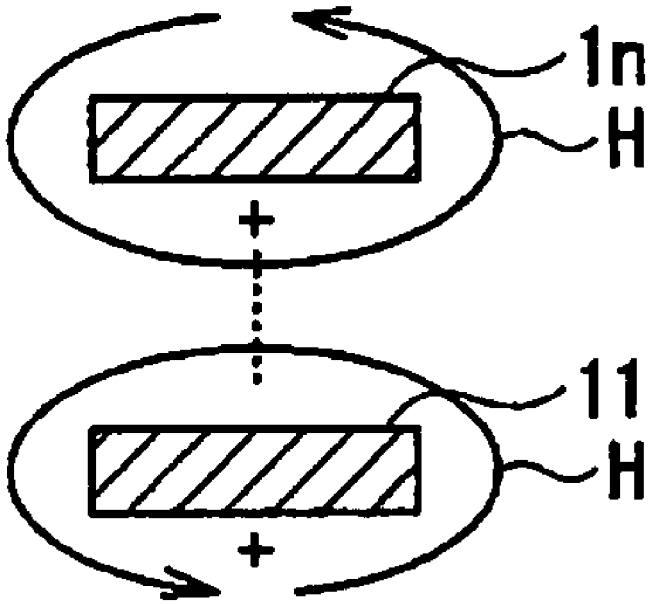
FIGS. 5A and 5B are a first explanatory drawing and a second explanatory drawing each illustrating a magnetic field distribution in two resonators which are comb-line coupled to each other.
Figure 5B:
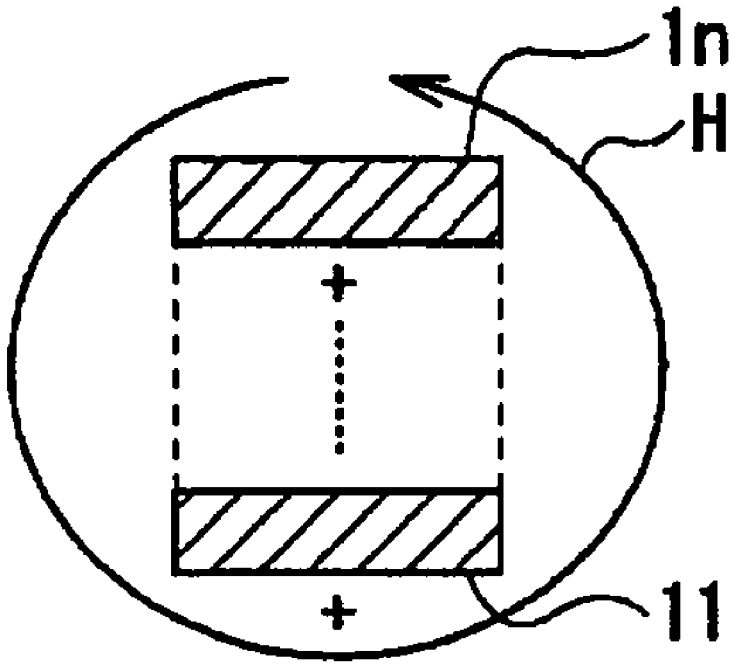

FIG. 4 schematically illustrates the distribution of a current i in the plurality of conductor lines 11, 12, . . . 1*n* which are comb-line coupled to each other. FIGS. 5A and 5B schematically illustrate the distribution of a magnetic field H in the plurality of conductor lines 11, 12, . . . 1*n* illustrated in FIG. 4. Specifically, FIGS. 5A and 5B illustrate magnetic field distributions within a cross section orthogonal to the direction of flow of the current i in the plurality of conductor lines 11, 12, . . . 1*n* illustrated in FIG. 4. In FIGS. 5A and 5B, the direction of flow of the current i is a direction orthogonal to the drawing surface. In the plurality of conductor lines 11, 12, . . . 1*n* which are comb-line coupled to each other, as illustrated in FIG. 5A, a magnetic field H is distributed in the same direction (for example, in a counterclockwise direction) within the cross section. In this case, when the plurality of conductor lines 11, 12, . . . 1*n* are strongly comb-line coupled to each other by narrowing the distance between the conductor lines in the stacking direction, this leads to a magnetic field distribution equivalent to a state where the plurality of conductor lines 11, 12, . . . 1*n* are virtually regarded as a conductor, as illustrated in FIG. 5B. That is, the conductor thickness can be increased virtually. This stacked resonator is adapted to increase the conductor thickness so as to reduce the conductor loss by using the characteristic that the current i flows in the same direction in the plurality of conductor lines 11, 12, . . . 1*n* which are comb-line coupled to each other. The same is true for the other plurality of conductor lines 21, 22 . . . 2*n*.

In this stacked resonator, when the plurality of conductor lines 11, 12, . . . 1*n* are regarded in whole as one resonator, and the plurality of conductor lines 21, 22, . . . 2*n* are regarded in whole as another resonator, the result can be, equivalently, to a stacked resonator constructed of a pair of interdigital-coupled resonators 10 and 20 each using one end thereof as an open end, and the other end thereof as a short-circuit end, as shown in FIG. 2. Here, consider the case where the pair of quarter-wave resonators are of interdigital type and strongly coupled to each other. As the result, with respect to a resonance frequency $f_0$ in each of the quarter wave resonators when establishing no interdigital-coupling (i.e., the resonance frequency determined by the physical length of a quarter-wave), there appear two resonance modes of a first resonance mode in which a resonance at a first resonance frequency $f_1$ higher than the resonance frequency $f_0$ is produced, and a second resonance mode in which a resonance at a second resonance frequency $f_2$ lower than the resonance frequency $f_0$ is produced, and the resonance frequency is then separated into two. In this case, by setting, as an operating frequency as a resonator, the second resonance frequency $f_2$ lower than the resonance frequency $f_0$ corresponding to the physical length, miniaturization can be facilitated than the case of setting the operating frequency to the resonance frequency $f_0$. Further, in the second resonance mode of a lower frequency, the current i flows in the same direction to the respective conductor lines in the pair of quarter-wave resonators 10 and 20, and the conductor thickness can be increased artificially thereby to reduce the conductor loss.

The following is a more detailed description of the operation and effect attainable through interdigital-coupling. Techniques for coupling two resonators constructed of the TEM line are of two general types: comb-line coupling, and interdigital-coupling. It is known that interdigital coupling produces extremely strong coupling.

Figure 6:
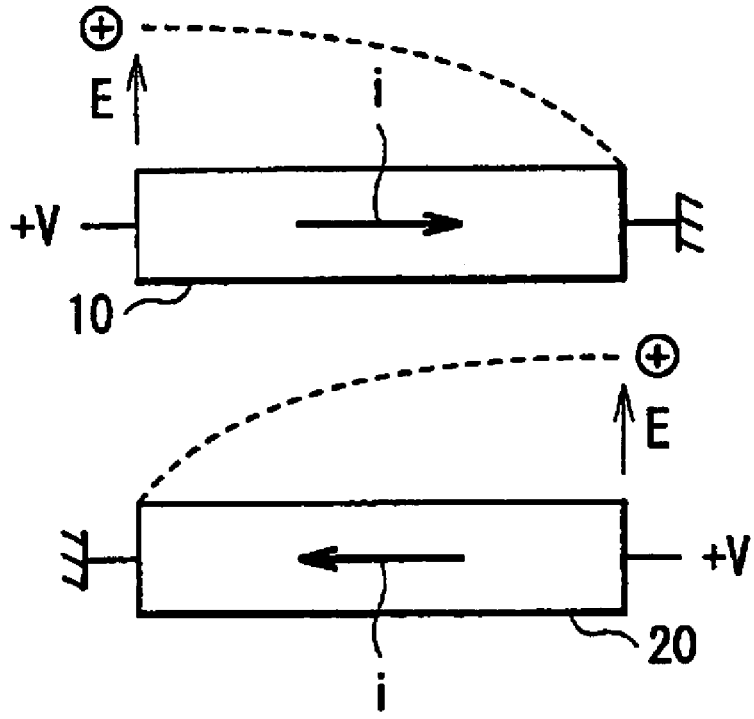
FIG. 6 is an explanatory drawing illustrating a first resonance mode of a pair of quarter-wave resonators which are interdigital-coupled to each other.
Figure 7:
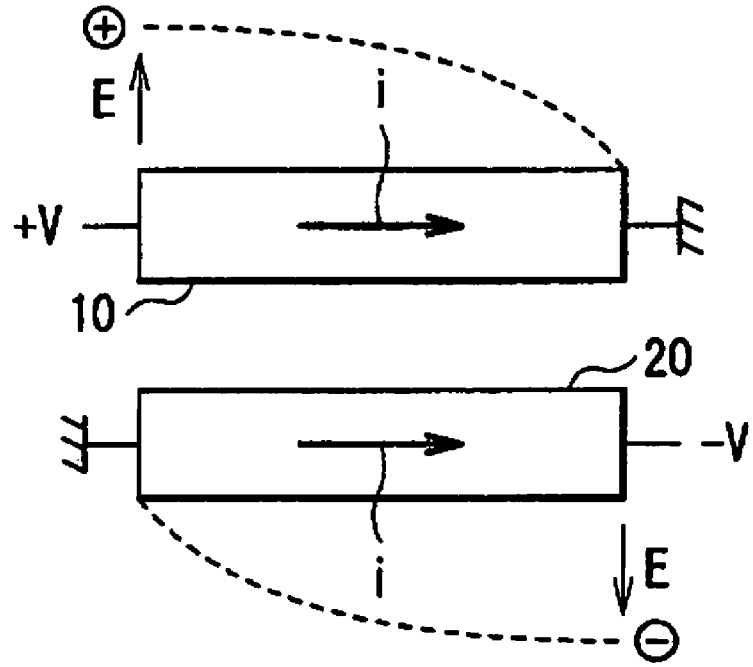
FIG. 7 is an explanatory drawing illustrating a second resonance mode of the pair of quarter-wave resonators which are interdigital-coupled to each other.

In the pair of quarter-wave resonators 10 and 20 which are interdigital-coupled to each other, a resonance mode can be separated into two inherent resonance modes. FIG. 6 illustrates a first resonance mode in the pair of interdigital-coupled quarter-wave resonators 10 and 20, and FIG. 7 illustrates a second resonance mode thereof. In FIGS. 6 and 7, the curves indicated by the broken line represent distributions of an electric field E in the respective resonators.

In the first resonance mode, a current i flows from the open end side to the short-circuit end side in the pair of quarter-wave resonators 10 and 20, respectively, and the currents i passing through these resonators reverse in direction. In the first resonance mode, an electromagnetic wave is excited in the same phase by the pair of quarter-wave resonators 10 and 20.

On the other hand, in the second resonance mode, the current i flows from the open end side to the short-circuit end side in one quarter-wave resonator 10, and the current i flows from the short-circuit end side to the open end side in the other quarter-wave resonator 20, so that the currents i passing through these resonators flow in the same direction. That is, in the second resonance mode, an electromagnetic wave is excited in phase opposition by the pair of quarter-wave resonators 10 and 20, as can be seen from the distribution of the electric field E. In the second resonance mode, the phase of the electric field E is shifted 180 degrees at such positions as to be mutually rotation symmetry with respect to a physical axis of rotation symmetry, as a whole of the pair of quarter-wave resonators 10 and 20.

In the case of the structure of rotation symmetry, the resonance frequency of the first resonance mode can be expressed by $f_1$ in the following equation (1A), and the resonance frequency of the second resonance mode can be expressed by $f_2$ in the following equation (1B).

$$\begin{cases} f_1 = \dfrac{c}{\pi\sqrt{\varepsilon_r}l}\tan^{-1}\left(\sqrt{\dfrac{Z_e}{Z_o}}\right) & \text{(1A)} \\ f_2 = \dfrac{c}{\pi\sqrt{\varepsilon_r}l}\tan^{-1}\left(\sqrt{\dfrac{Z_o}{Z_e}}\right) & \text{(1B)} \end{cases}$$

wherein c is a light velocity; $\epsilon_r$ is an effective relative permittivity; l is a resonator length; $Z_e$ is a characteristic impedance of an even mode; and $Z_o$ is a characteristic impedance of an odd mode.

In a coupling transmission line of bilateral symmetry, a transmission mode for propagating to the transmission line can be decomposed into two independent modes of an even mode and an odd mode (which do not interfere with each other).

Figure 8A:
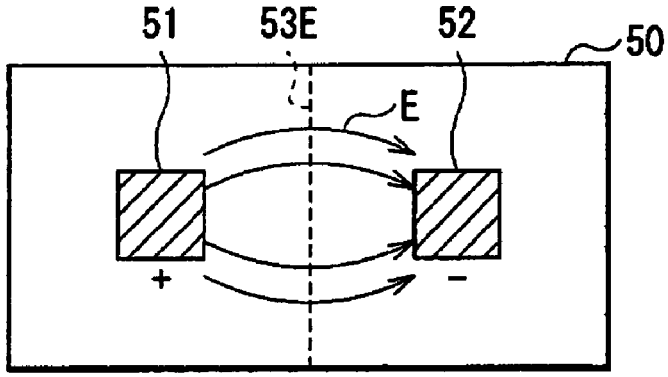
FIGS. 8A and 8B are explanatory drawings illustrating an electric field distribution in an odd mode in transmission modes of a coupling transmission line of bilateral symmetry, and an electric field distribution in an even mode, respectively.
Figure 8B:
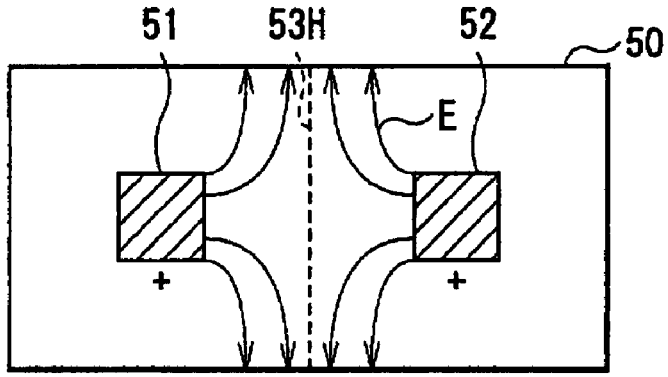

FIG. 8A illustrates a distribution of the electric field E in the odd mode of the coupling transmission line, and FIG. 8B illustrates a distribution of the electric field E in the even mode. In FIGS. 8A and 8B, a ground layer 50 is formed at a peripheral portion, and conductor lines 51 and 52 of bilateral symmetry are formed in the inside. FIGS. 8A and 8B illustrate electric field distributions within a cross section orthogonal to a transmission direction of the coupling transmission line, and the direction of transmission of a signal is orthogonal to the drawing surface.

Figure 9A:
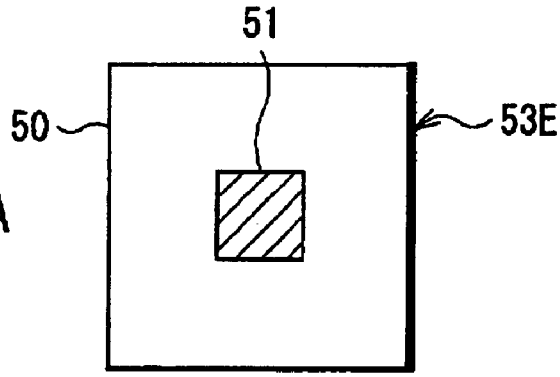
FIGS. 9A and 9B are explanatory drawings illustrating the structure of a transmission line equivalent to the coupling transmission line of bilateral symmetry, FIGS. 9A and 9B illustrating an odd mode and an even mode in the equivalent transmission line, respectively.

As illustrated in FIG. 8A, in the odd mode, the electric fields cross perpendicularly with respect to a symmetrical plane of the conductor lines 51 and 52, and the symmetrical plane becomes a virtual electrical wall 53E. FIG. 9A illustrates a transmission line equivalent to that illustrated in FIG. 8A. As illustrated in FIG. 9A, a structure equivalent to the line composed only of the conductor line 51 can be obtained by replacing the symmetrical plane with the actual electrical wall 53E (a wall of zero potential, or a ground). The characteristic impedance by the line illustrated in FIG. 9A becomes a characteristic impedance $Z_0$ in the odd mode in the above-mentioned equations (1A) and (1B).

Figure 9B:
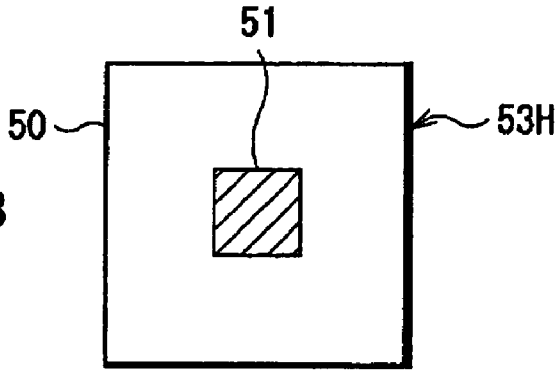

On the other hand, in the even mode, the electric fields are balanced with respect to a symmetrical plane of the conductor lines 51 and 52, as illustrated in FIG. 8B, so that the magnetic fields cross perpendicularly with respect to the symmetrical plane. In the even mode, the symmetrical plane becomes a virtual magnetic wall 53H. FIG. 9B illustrates a transmission line equivalent to that illustrated in FIG. 8B. As illustrated in FIG. 9B, a structure equivalent to the line composed only of the conductor line 51 can be obtained by replacing the symmetrical plane with the actual magnetic wall 53H (a wall whose impedance is infinity). The characteristic impedance by the line illustrated in FIG. 9B becomes a characteristic impedance $Z_e$ in the even mode in the above-mentioned equations (1A) and (1B).

In general, a characteristic impedance Z of a transmission line can be expressed by a ratio of a capacity C with respect to a ground per unit length of a signal line, and an inductance component L per unit length of a signal line. That is, $$Z=\sqrt{(L/C)} \tag{2}$$

wherein $\sqrt{}$ indicates a square root of the entire (L/C).

In the characteristic impedance $Z_o$ in the odd mode, the symmetrical plane becomes a ground (the electric wall 53E) from the line structure of FIG. 9A, and the capacity C with respect to the ground is increased. Hence, from the equation (2), the value of $Z_o$ is decreased. On the other hand, in the characteristic impedance $Z_e$ in the even mode, the symmetrical plane becomes the magnetic wall 53H from the line structure of FIG. 9B, and the capacity C is decreased. Hence, from the equation (2), the value of $Z_e$ is increased.

Taking the above-described matter into account, consider now the equations (1A) and (1B), which are the resonance frequencies of the resonance modes of the pair of quarter-wave resonators 10 and 20 which are interdigital-coupled to each other. Since the function of an arc tangent is a monotone increase function, the resonance frequency increases with an increase in a portion regarding $\tan^{-1}$ in the equations (1A) and (1B), and decreases with a decrease in the portion. That is, the value of the characteristic impedance $Z_o$ in the odd mode is decreased, and the value of the characteristic impedance $Z_e$ in the even mode is increased. As the difference therebetween increases, the resonance frequency $f_1$ of the first resonance mode increases from the equation (1A), and the resonance frequency $f_2$ of the second resonance mode decreases from the equation (1B).

Accordingly, by increasing the ratio of the symmetrical plane of transmission paths to be coupled, the first resonance frequency $f_1$ and the second resonance frequency $f_2$ depart from each other, as illustrated in FIG. 10. FIG. 10 illustrates a distribution state of resonance frequencies in the pair of interdigital-coupled quarter-wave resonators 10 and 20. An intermediate resonance frequency $f_0$ of the first resonance frequency $f_1$ and the second resonance frequency $f_2$ is a frequency at the time of resonance at a quarter-wave that is determined by the physical length of a line (i.e., the resonance frequency in each of the quarter-wave resonators when establishing no interdigital-coupling). Here, increasing the ratio of the symmetrical plane of the transmission paths corresponds to increasing the capacity C in the odd mode from the equation (2). Increasing the capacity C corresponds to enhancing the degree of coupling of a line. Therefore, in the pair of interdigital-coupled quarter-wave resonators 10 and 20, a stronger coupling between the resonators causes further separation between the first resonance frequency $f_1$ and the second resonance frequency $f_2$.

The strong coupling between the pair of quarter-wave resonators 10 and 20 of interdigital type provides the following advantages. That is, the resonance frequency $f_0$ that is determined by the physical length of a quarter-wave can be divided into two. Specifically, there occur a first resonance mode in which a resonance at a first resonance frequency $f_1$ higher than a resonance frequency $f_0$ is produced, and a second resonance mode in which a resonance at a second resonance frequency $f_2$ lower than the resonance frequency $f_0$ is produced.

In this case, by setting the second resonance frequency $f_2$ of a low frequency as an operating frequency (a passing frequency if configured as a filter), there is a first advantage of further reducing the dimension of the entire resonator than the case of setting the operating frequency to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band.

A second advantage is that the coupling of the balanced terminal leads to superior balance characteristics. As described above with reference to FIGS. 6 and 7, the pair of interdigital-coupled quarter-wave resonators 10 and 20 are excited in the same phase in the first resonance mode, and excited in phase opposition in the second resonance mode. Therefore, no common-mode can be excited, and only a reverse phase can exist with respect to a filter passing frequency (namely the second resonance frequency $f_2$), by allowing the pair of quarter-wave resonators to be strongly interdigital-coupled, and setting the first resonance frequency $f_1$ to a sufficiently high value that is satisfactorily away from the second resonance frequency $f_2$. This improves balance characteristics. From the point of view of this, it is desirable that the first resonance frequency $f_1$ be sufficiently higher than the frequency band of an input signal. For example, it is desirable that the first resonance frequency $f_1$ exceed three times the second resonance frequency $f_2$. That is, it is desirable to satisfy the following condition:

$$f_1>3f_2$$

If the second resonance frequency $f_2$ of a lower frequency is set to the passing frequency as a filter, frequency characteristics may be deteriorated when the frequency band of the input signal overlaps with the first resonance frequency $f_1$. This is avoidable by setting the first resonance frequency $f_1$ to be higher than the frequency band of the input signal.

A third advantage is that conductor loss can be reduced. FIGS. 11A and 11B illustrate schematically a distribution of a magnetic field H in the pair of quarter-wave resonators 10 and 20 which are interdigital-coupled to each other. Specifically, FIGS. 11A and 11B illustrate magnetic field distributions within a cross section orthogonal to the direction of flow of the current i in the second resonance mode in the pair of quarter-wave resonators 10 and 20 as illustrated in FIG. 7. The direction of flow of the current i is a direction orthogonal to the drawing surface. In the second resonance mode, as illustrated in FIG. 11A, the magnetic field H is distributed in the same direction (for example, in a counterclockwise direction) within the cross section in the pair of quarter-wave resonators 10 and 20. In this case, when these resonators are strongly interdigital-coupled to each other (the pair of quarter-wave resonators 10 and 20 are brought into closer relationship), this leads to a magnetic field distribution equivalent to a state where the pair of quarter-wave resonators 10 and 20 are virtually regarded as a conductor, as illustrated in FIG. 11B. That is, the conductor thickness can be increased virtually, and hence the conductor loss becomes lessened.

As discussed above, in accordance with the first preferred embodiment, each of the pair of quarter-waver resonators 10 and 20 is constructed of the plurality of conductor lines, and these conductor lines are stacked and arranged in comb-line coupling. Therefore, the conductor thickness of each of the pair of quarter-wave resonators 10 and 20 can be increased virtually, and the conductor loss can be reduced. Additionally, the interdigital-coupling of the pair of quarter-wave resonators 10 and 20 facilitates miniaturization. These enable to realize miniaturization and minimum loss. The pair of quarter-wave resonators 10 and 20 have, as a whole, the structure of rotation symmetry having the axis of rotation symmetry, and the pair of balanced terminals 4A and 4B are connected to the pair of quarter-wave resonators 10 and 20 at such positions as to be mutually rotation-symmetric with respect to the axis of rotation symmetry 5, thereby enabling a balanced signal to be transmitted with superior balance characteristics.

Second Preferred Embodiment

A stacked resonator according to a second preferred embodiment of the present invention will next be described. The same reference numerals have been used as in the above-mentioned first preferred embodiment for substantially identical components, with the description thereof omitted.

Figure 12:
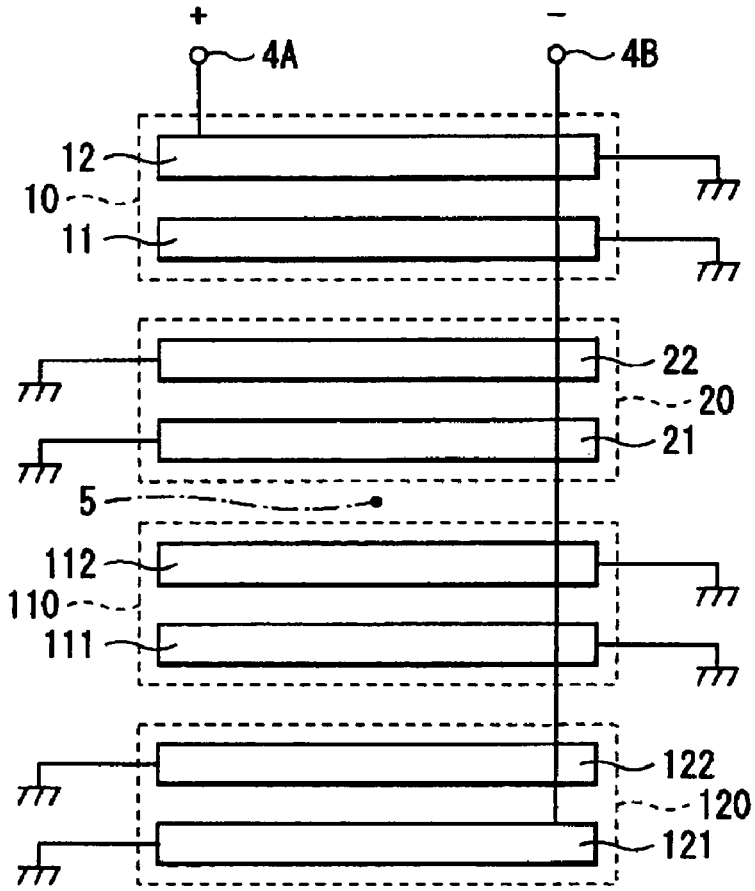
FIG. 12 is a block diagram illustrating a basic configuration of a stacked resonator according to a second preferred embodiment of the present invention.
Figure 13:
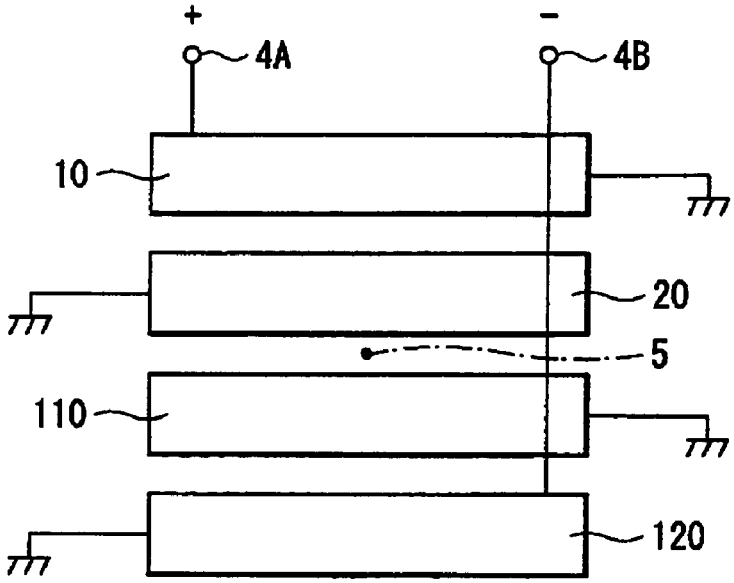
FIG. 13 is a block diagram illustrating an equivalent configuration of the stacked resonator in the second preferred embodiment.

FIG. 12 illustrates a basic configuration of the stacked resonator of the second preferred embodiment. FIG. 13 illustrates an equivalent configuration of the stacked resonator in the second preferred embodiment. The stacked resonator according to the first preferred embodiment is provided with a set of the pair of quarter-wave resonators 10 and 20, whereas the stacked resonator according to the second preferred embodiment is provided with a plurality of pairs of quarter-wave resonators, which are configured in a multistage. The configuration example of FIG. 12 is provided with two sets of one pair of quarter-wave resonators 10 and 20, and the other pair of quarter-wave resonators 110 and 120. Without limiting to the example of FIG. 12, there may be provided with three or more sets of a pair of quarter-wave resonators.

One pair of quarter-wave resonators 10 and 20 and the other pair quarter-wave resonators 110 and 120 are stacked and arranged in the same direction so as to oppose to each other. Like one pair of quarter-wave resonators 10 and 20, the other the pair of quarter-wave resonators 110 and 120 are constructed of a plurality of conductor lines which are comb-line coupled to each other. In the example of FIG. 12, the pair of quarter-wave resonators 10 and 20 are provided wherein one quarter-wave resonator 10 is constructed of two conductor lines 11 and 12 and the other quarter-wave resonator 20 is constructed of two conductor lines 21 and 22, and the other pair of quarter-wave resonators 110 and 120 are provided wherein one quarter-wave resonator 110 is also constructed of two conductor lines 121 and 122 and the other quarter-wave resonator 122 is also constructed of conductor lines 121 and 122. Without limiting to this example, each of the quarter-wave resonators may be provided with three or more conductor lines.

When in the pair of quarter-wave resonators 110 and 120, the conductor lines 111 and 112 are regarded artificially in whole as one resonator, and the other conductor liens 121 and 122 are regarded in whole as another resonator, it can be considered, as shown in FIG. 13, equivalently as a structure where the pair of quarter-wave resonators 110 and 120 are interdigital-coupled to each other, each using one end thereof as the open end, and the other end thereof as the short-circuit end, as in the case with the pair of quarter-wave resonators 10 and 20. Here, the pair of quarter-wave resonators 10 and 20 are electromagnetically coupled each other and the other pair of quarter-wave resonators 110 and 120 are electromagnetically coupled to each other. The example of FIG. 13 can also be considered that the adjacent quarter-wave resonators are interdigital-coupled to each other, and as the result, three sets of the pair of quarter-wave resonators are formed by the adjacent quarter-wave resonators. That is, it can be considered that, from the upper layer side to the lower layer side, the quarter-wave resonators 10 and 20 form a first pair of quarter-wave resonators, the quarter-wave resonators 20 and 110 form a second pair of quarter-wave resonators, and the quarter-wave resonators 110 and 120 form a third pair of quarter-wave resonators.

This stacked resonator has, as a whole, a structure of rotation symmetry having an axis of rotation symmetry 5, including the pair of quarter-wave resonators 10 and 20 and the other pair of quarter-wave resonators 110 and 120. In order to obtain the structure of rotation symmetry, the line intervals of the conductor lines constituting each quarter-wave resonator are preferably the same. In this stacked resonator, one terminal 4A and the other terminal 4B of a pair of balanced intervals 4A and 4B are preferably connected to any two quarter-wave resonators at such positions as to be mutually rotation-symmetric with respect to the axis of rotation symmetry 5. For example, one terminal 4A may be connected to the quarter-wave resonator 10 of the uppermost layer, and the other terminal 4B may be connected to the quarter-wave resonator 120 of the lowermost layer. This provides superior balance characteristics. Alternatively, a plurality of sets of the pair of balanced terminals 4A and 4B may be provided. Also in this case, it is desirable that each pair of balanced terminals 4A and 4B be connected to a pair of quarter-wave resonators at such positions as to be mutually rotation symmetry with respect to the axis of rotation symmetry 5.

Figure 14:
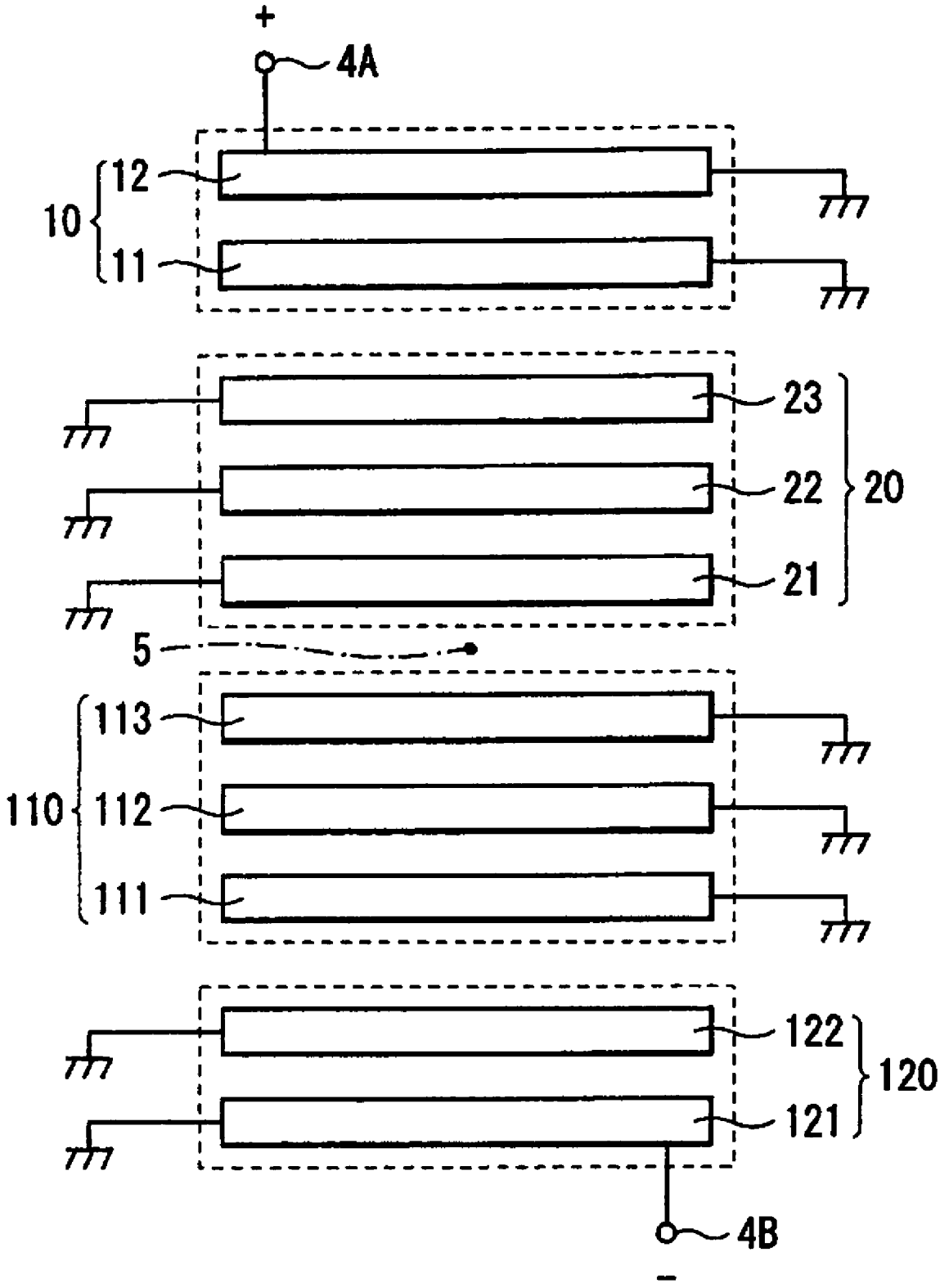
FIG. 14 is a block diagram illustrating another example of the configuration of the stacked resonator in the second preferred embodiment.

In an alternative, if the structure is of rotation symmetry as a whole, the number of conductor lines constituting the individual quarter-wave resonators may differ in part. An example thereof is illustrated in FIG. 14. In the example of configuration in FIG. 14, the quarter-wave resonators 10 and 120 in each of the uppermost layer and the lowermost layer is constructed of two conductor lines 11 and 12 and conductor lines 121 and 122, respectively, and the quarter-wave resonators 20 and 110 in a middle stage are constructed of three conductor lines 21, 22 and 23, and conductor lines 111, 112 and 113, respectively. This configuration can also provide, as a whole, the structure of rotation symmetry having the axis of rotation symmetry 5.

In accordance with the second preferred embodiment, all of the individual quarter-wave resonators in the plurality sets of the pair of quarter-wave resonators are stacked and arranged in the same direction, thus facilitating area saving than the case, for example, where a plurality of sets of a pair of quarter-wave resonators are arranged side by side in a plane direction. Further, the stacked arrangement of the individual quarter-wave resonators in the same direction facilitates to enhance the coupling between the pair of quarter-wave resonators, thus enabling a broad-band balanced signal to be transmitted with superior balance characteristics when the pair of balanced terminals 4A and 4B are connected to each other.

Third Preferred Embodiment

A third preferred embodiment of the present invention will be described below. The present embodiment describes a filter using the stacked resonator according to the first preferred embodiment mentioned above. The same reference numerals have been used as in the above-mentioned first preferred embodiment for substantially identical components, with the description thereof omitted.

Figure 15:
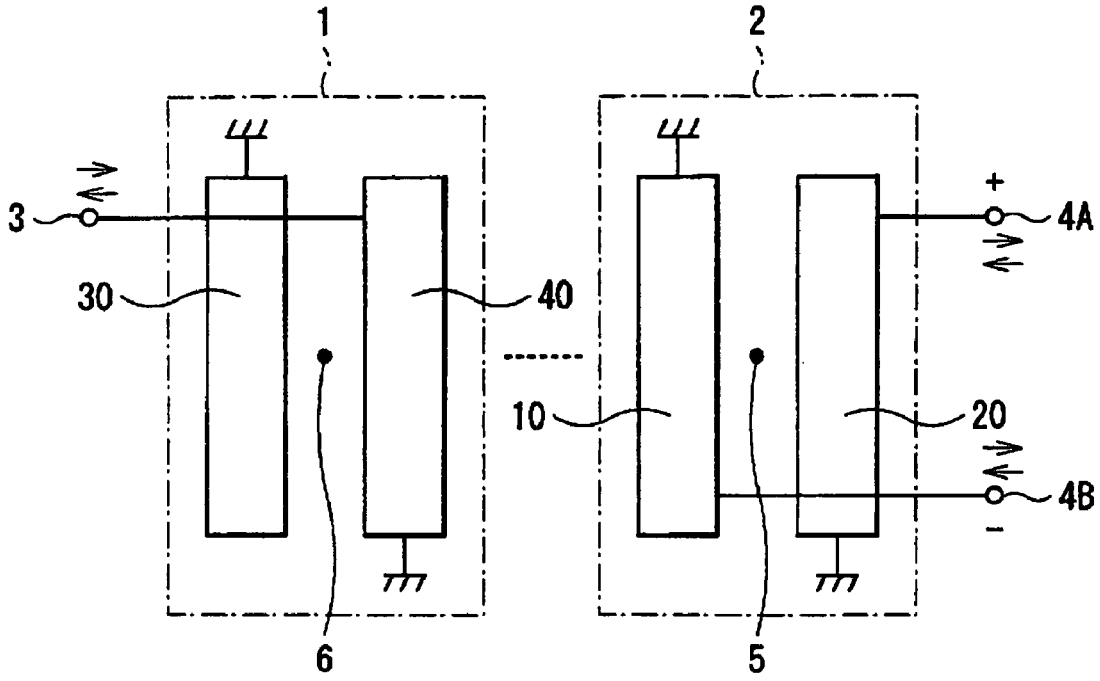
FIG. 15 is a block diagram illustrating an equivalent configuration of a filter according to a third preferred embodiment of the present invention.
Figure 16:
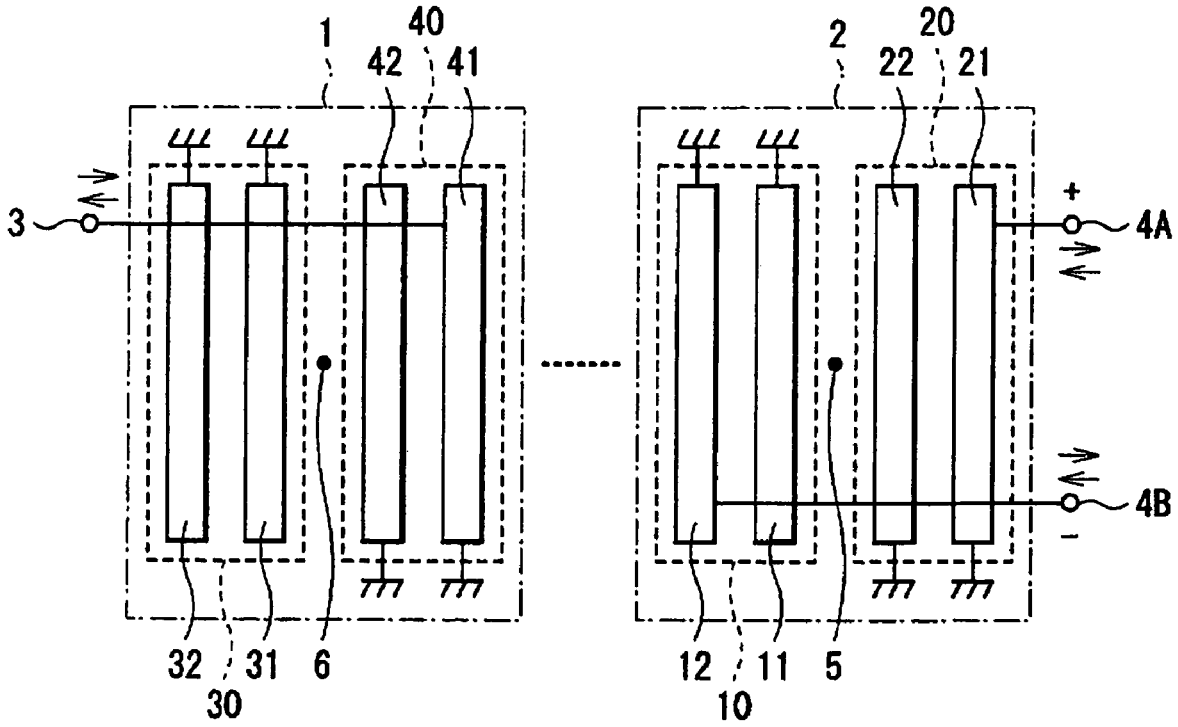
FIG. 16 is a block diagram illustrating a basic configuration of the filter in the third preferred embodiment.

FIG. 16 illustrates a basic configuration of the filter in the third preferred embodiment. FIG. 15 illustrates an equivalent configuration of the filter in the third preferred embodiment. The present embodiment describes taking as example a filter of unbalanced input/balanced output type or balanced input/unbalanced output type, having a balanced terminal only on either an input end side or an output end side, and having an unbalanced terminal on the other. This filter is provided with a first resonator 1, a second resonator 2, an unbalanced terminal 3 connected to the first resonator 1, and a pair of balanced terminals 4A and 4B connected to the second resonator 2. For example, by using the unbalanced terminal 3 as an input terminal, and the pair of balanced terminals 4A and 4B as output terminals, a filter of unbalanced input/balanced output type may be configured as a whole. Alternatively, by using the unbalanced terminal 3 as an output terminal, and the pair of balanced terminals 4A and 4B as input terminals, a filter of balanced input/unbalanced output type may be configured as a whole.

The second resonator 2 has the same configuration as the stacked resonator according to the foregoing first preferred embodiment. That is, it is constructed of a pair of quarter-wave resonators 10 and 20 which are interdigital-coupled to each other, and a pair of balanced terminals 4A and 4B are connected to the resonators 10 and 20, respectively, in the same manner as in the first preferred embodiment.

Like the second resonator 2, the first resonator 1 is also constructed of a pair of quarter-wave resonators 30 and 40 which are interdigital-coupled to each other. In the first resonator 1, the unbalanced terminal 3 is connected to one of the pair of quarter-wave resonators 30 and 40. Alternatively, a plurality of unbalanced terminals 3 may be provided so that the unbalanced terminal 3 can be connected to both of the pair of quarter-wave resonators 30 and 40. Like the pair of quarter-wave resonators 10 and 20, the pair of quarter-wave resonators 30 and 40 have, as a whole, the structure of rotation symmetry having an axis of rotation symmetry 6.

Like the pair of quarter-wave resonators 10 and 20 in the second resonator 2, the pair of quarter-wave resonators 30 and 40 in the first resonator are constructed of a plurality of conductor lines which are comb-line coupled to each other. In the example of configuration in FIG. 16, the pair of quarter-wave resonators 10 and 20 are provided wherein one quarter-wave resonator 10 is constructed of two conductor lines 11 and 12 and the other quarter-wave resonator 20 is constructed of conductor lines 21 and 22, and the pair of quarter-wave resonators 30 and 40 in the first resonator are also provided wherein one quarter-wave resonator 30 is constructed of two conductor lines 31 and 32 and the other quarter-wave resonator 40 is constructed of conductor lines 41 and 42. Without limiting to this, each quarter-wave resonator may be constructed of three or more conductor lines. The first resonator 1 and the second resonator 2 are required to have independently the structure of rotation symmetry, and the first resonator 1 and the second resonator 2 may have different numbers of conductor lines.

Here, in the pair of quarter-wave resonators 30 and 40 in the first resonator 1, when the conductor lines 31 and 32 are virtually regarded in whole as one resonator, and the other the pair of conductor lines 41 and 42 are regarded in whole as another resonator, it can be considered, as shown in FIG. 15, equivalently as a structure where the pair of quarter-wave resonators 30 and 40 are interdigital-coupled to each other, each using one end thereof as the open end, and the other end thereof as the short-circuit end, as in the pair of quarter-wave resonators 10 and 20.

As described above in the first preferred embodiment, the pair of quarter-wave resonators 10 and 20 in the second resonator 2 are strongly interdigital-coupled to each other so that they can have a first resonance mode in which a resonance at a first resonance frequency $f_1$ is produced, and a second resonance mode in which a resonance at a second resonance frequency $f_2$ lower than the resonance frequency $f_1$ is produced, and that the operating frequency becomes the second resonance frequency $f_2$. Similarly, the pair of quarter-wave resonators 30 and 40 in the first resonator 1 are configured so as to have the above-mentioned two resonance modes, and operate at the second resonance frequency $f_2$ which is a lower frequency. This filter is constructed so that the first resonator 1 and the second resonator 2 resonate and establish an electromagnetic coupling at the second resonance frequency $f_2$ which is a lower frequency. This results in a band pass filter of unbalanced input/balanced output type or balanced input/unbalanced output type, employing the second resonance frequency $f_2$ as a passing band.

Figure 17:
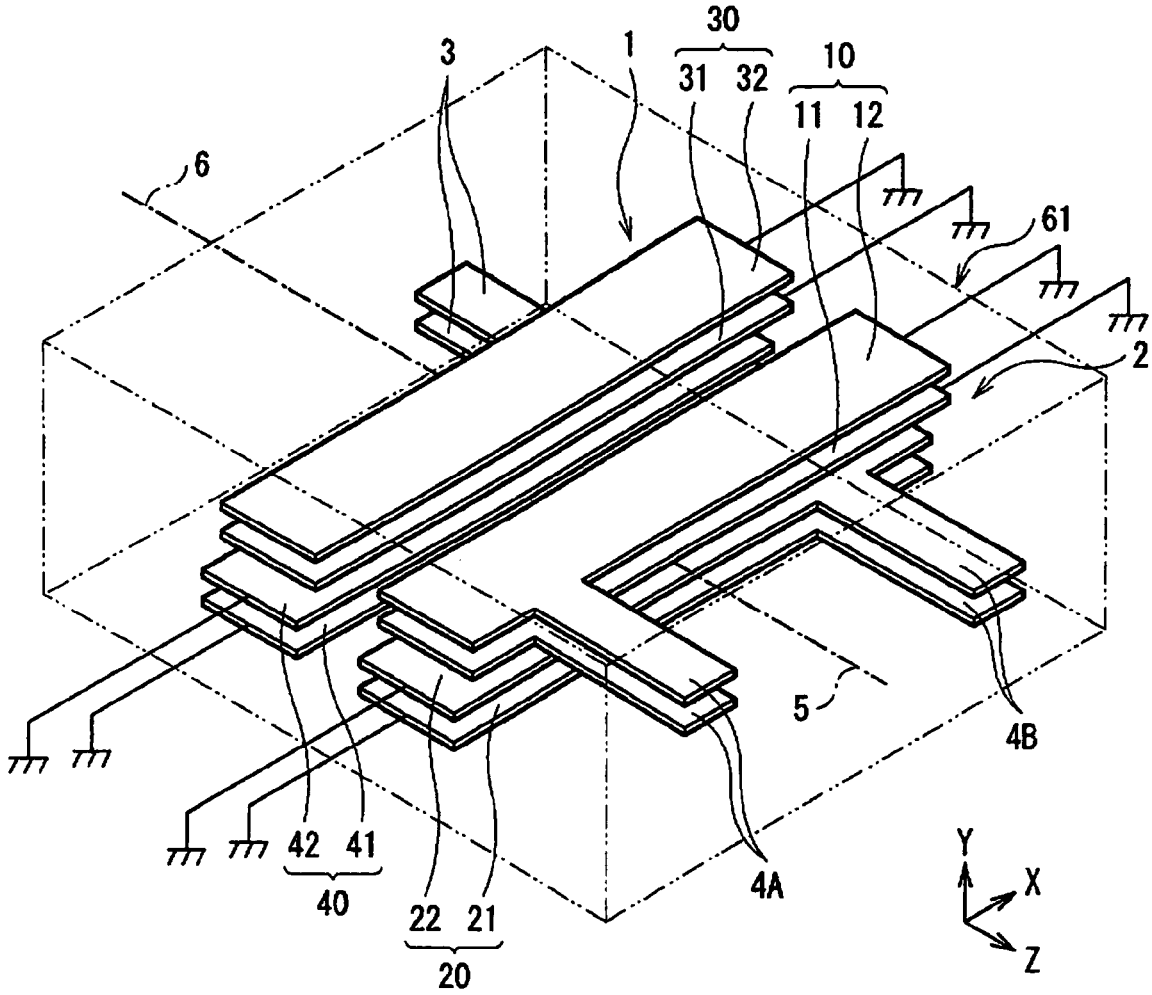
FIG. 17 is a perspective view illustrating a specific example of the configuration of the filter in the third preferred embodiment.

FIG. 17 illustrates a specific example of the configuration of the above filter. Like the specific example of the configuration of the stacked resonator of FIG. 3, this example is provided with a dielectric substrate 61 formed of a dielectric material, and the dielectric substrate 61 is of a multilayer structure. Specifically, in a second resonator 2, two sets of one balanced terminal 4A are connected to one quarter-wave resonator 10, and two sets of other balanced terminals 4B are connected to the other quarter-waver resonator 20, thereby forming two sets of the pair of balanced terminals 4A and 4B. Further, two sets of unbalanced terminals 3 are connected to the quarter-wave resonator 40 in the first resonator 1. In this example, the pair of quarter-wave resonators 10 and 20 and the pair of quarter-wave resonators 30 and 40 are arranged side by side in a plane direction. A line pattern (a strip line) of the conductor is formed in the inside of the dielectric substrate 61, and this line pattern is used to form the pair of quarter-wave resonators 10 and 20, the pair of quarter-wave resonators 30 and 40, the two sets of balanced terminals 3, and the two sets of the pair of balanced terminals 4A and 4B. To obtain this structure, for example, a laminate structure may be formed by preparing a plurality of sheet-shaped dielectric substrates, forming individual line portions on the sheet-shaped dielectric substrates by using the line pattern of a conductor, and laminating the sheet-shaped dielectric substrates.

Although not illustrated, the dielectric substrate 61 is provided with a ground layer for grounding the short-circuit ends of the pair of quarter-wave resonators 10 and 20 and the pair of quarter-wave resonators 30 and 40. For example, the ground layer can be disposed on the upper surface, the bottom surface, or the inside of the dielectric substrate 61. In this case, for example, on the side surface of the dielectric substrate 61 where the respective conductor lines extend, the surfaces of the short-circuit ends of the respective conductor lines may be exposed, and a connecting conductor pattern for connecting to the ground layer may be disposed on the side surface of the part thus exposed, so that the individual short-circuit ends of the respective conductor lines are caused to be conducting to the ground layer with the connecting conductor pattern interposed therebetween. Alternatively, a through-hole may be formed between each of the short-circuit ends of the respective conductor lines and the ground layer, so that the conduction between the two can be established by the through-hole.

The operation of the filter according to the third preferred embodiment will be described below.

In this filter, by the operations of the respective resonators between the input end and the output end, an unbalanced signal inputted from the unbalanced terminal 3 is subjected to filtering with the second resonance frequency $f_2$ as a passing band, and then outputted as a balanced signal, from the pair of balanced output terminals 4A and 4B. Alternatively, balanced signals inputted from the balanced input terminals 4A and 4B are subjected to filtering with the second resonance frequency $f_2$ as a passing band, and then outputted as an unbalanced signal, from the unbalanced terminal 3.

In this filter, the respective quarter-wave resonators in the first resonator 1 and the second resonator 2 are constructed of a plurality of conductor lines, and these conductor lines are stacked and arranged so as to establish a comb-line coupling. This virtually increases the conductor thickness of the respective quarter-wave resonators in the first and second resonators 1 and 2, thereby reducing the conductor loss. This principle is as described above with reference to FIG. 4 and FIGS. 5A and 5B in the first preferred embodiment.

Additionally, in this filter, by employing, as a passing band, the second resonance frequency $f_2$ which is a lower frequency in the pair of interdigital-coupled quarter-wave resonators, miniaturization can be facilitated than the filter of the related art, and the balanced signal can be transmitted with superior balance characteristics. The operation and effect obtainable from the inter-digital coupling are as described above in the first preferred embodiment.

Like the second preferred embodiment, the first resonator 1 and the second resonator 2 in the third preferred embodiment may be constructed of a plurality of pairs of quarter-wave resonators.

Fourth Preferred Embodiment

A filter according to a fourth preferred embodiment of the present invention will be described below. The same reference numerals have been used as in the above-mentioned third preferred embodiment for substantially identical components, with the description thereof omitted.

Figure 18:
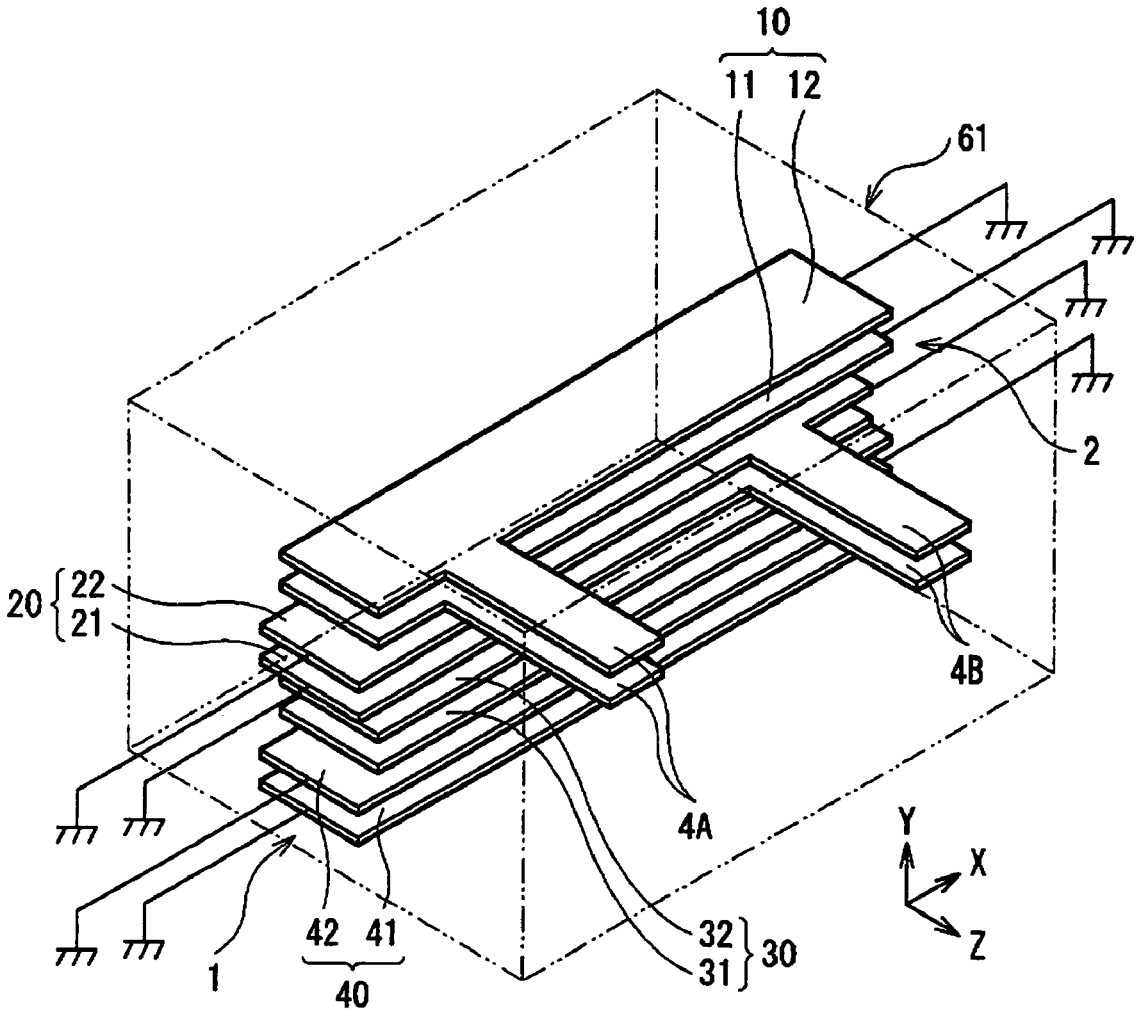
FIG. 18 is a perspective view illustrating a specific example of the configuration of a filter according to a fourth preferred embodiment of the present invention.
Figure 19:
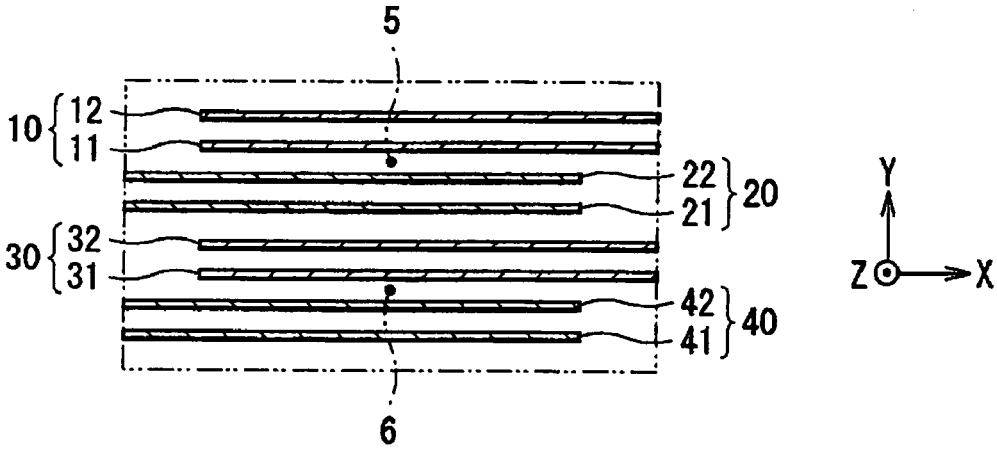
FIG. 19 is a sectional view illustrating the specific example of the configuration of the filter in the fourth preferred embodiment.

FIGS. 18 and 19 illustrate an example of the configuration of the filter according to the fourth preferred embodiment. FIG. 19 illustrates a cross-sectional structure in the longitudinal direction of this filter. In the configuration example as illustrated in FIG. 17 in the third preferred embodiment, the pair of quarter-wave resonators 10 and 20 which constitutes the second resonator 2, and the pair of quarter-wave resonators 30 and 40 which constitutes the first resonator 1 are arranged side by side in the plane direction. On the other hand, in the fourth preferred embodiment, the first resonator 1 and the second resonator 2 are stacked and arranged in the same direction so as to oppose to each other. Otherwise, the configuration is identical to that described with reference to FIG. 17.

In the filter according to the fourth preferred embodiment, all of the individual quarter-wave resonators, which constitute the first resonator 1 and the second resonator 2, are stacked and arranged in the same direction. This facilitates area saving than the case where the first resonator 1 and the second resonator 2 are arranged side by side in the plane direction.

Fifth Preferred Embodiment

A filter according to a fifth preferred embodiment of the present invention will be described below. The same reference numerals have been used as in the above-mentioned third preferred embodiment for substantially identical components, with the description thereof omitted.

Figure 20:
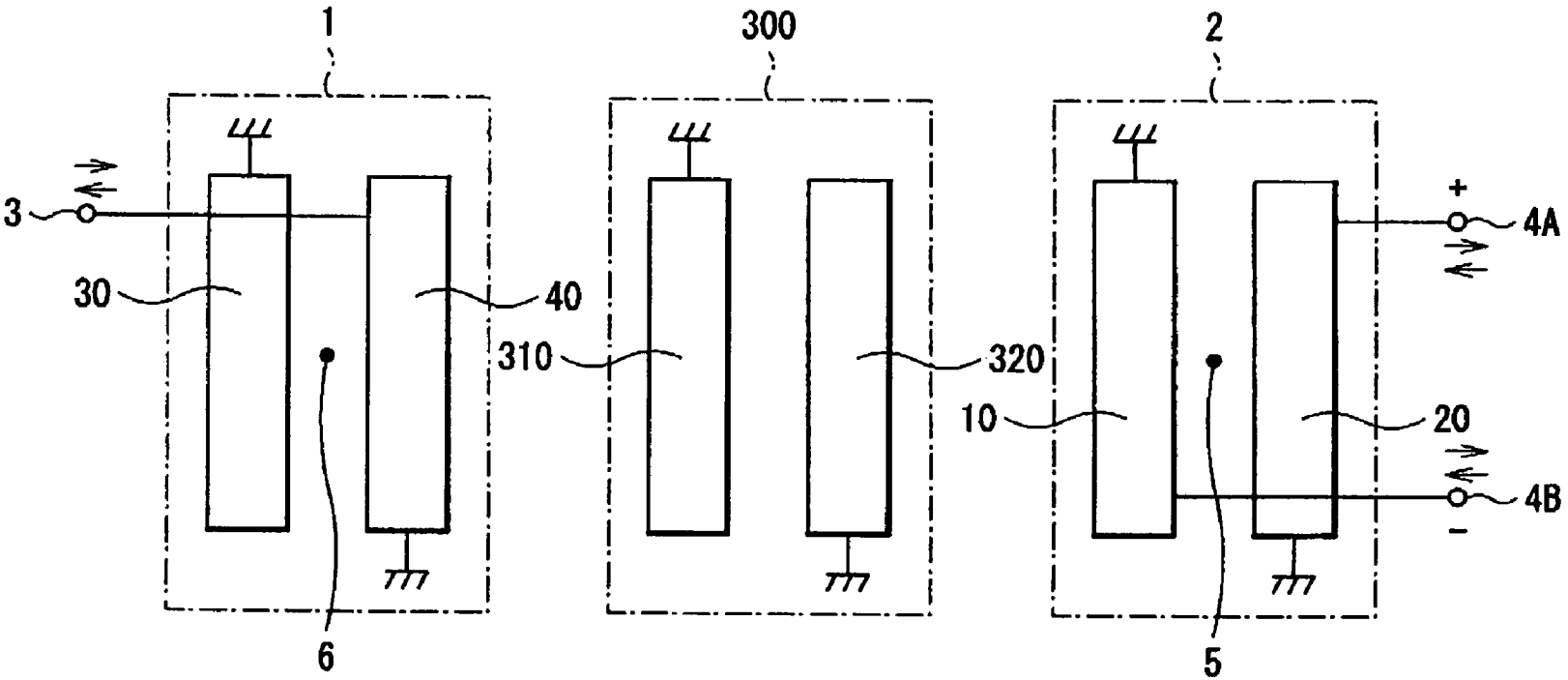
FIG. 20 is a block diagram illustrating an equivalent configuration of a filter according to a fifth preferred embodiment of the present invention.
Figure 21:
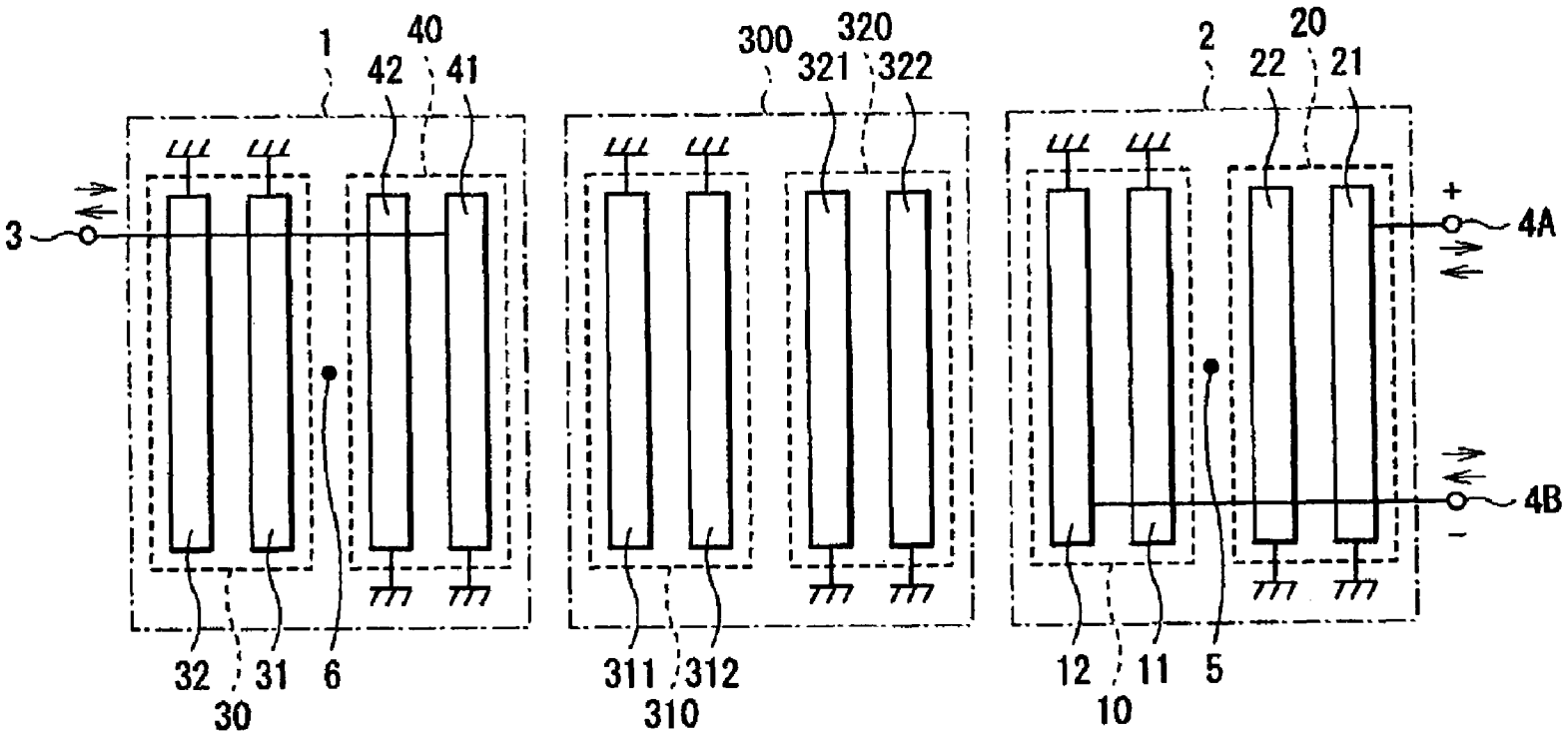
FIG. 21 is a block diagram illustrating a basic configuration of the filter in the fifth preferred embodiment.

FIG. 21 illustrates a basic configuration of the filter in the fifth preferred embodiment. FIG. 20 illustrates an equivalent configuration of this filter. The fifth preferred embodiment is attainable by adding a third resonator 300 at a middle stage between the first resonator 1 and the second resonator 2 in the filter according to the third preferred embodiment. Like the first resonator 1 and the second resonator 2, the third resonator 300 is constructed of a pair of quarter-wave resonators 310 and 320 which are interdigital-coupled to each other.

Like the pair of quarter-wave resonators 10 and 20 in the second resonator 2, the pair of quarter-wave resonators 310 and 320 in the third resonator 300 are also constructed of a plurality of conductor lines which are comb-line coupled to each other. In the constructional example of FIG. 21, the pair of quarter-wave resonators 310 and 320 are provided wherein one quarter-wave resonator 310 is constructed of two conductor lines 311 and 312 and the other quarter-wave resonator 320 is constructed of conductor lines 321 and 322, as in the case with the first resonator 1 and the second resonator 2. Without limiting to this example, each quarter-wave resonator may be provided with three or more conductor lines.

When applied to such a planar configuration as illustrated in FIG. 17, the third resonator 300 is to be arranged in a plane side by side in between the first resonator 1 and the second resonator 2. When applied to such a configuration as illustrated in FIG. 18, the third resonator 300 is to be stacked and arranged together with the first resonator 1 and the second resonator 2 in the same direction (vertically) in between the first resonator 1 and the second resonator 2. Alternatively, the third resonator 300 in the fifth preferred embodiment may be constructed of a plurality of pairs of quarter-wave resonators, as in the case with the second preferred embodiment.

Other Preferred Embodiments

It is to be understood that the present invention should not be limited to the foregoing preferred embodiments, and it is susceptible to make various changes and modifications. For example, though the foregoing third to fifth preferred embodiments have described the filter of the unbalanced input/balanced output type or the balanced input/unbalanced output type, the present invention is applicable to a filter having a balanced terminal at least either at the input end or the output end. That is, it is also applicable to a filter of balanced input/balanced output type where both of an input end and an output end are balanced terminals.

Figure 22:
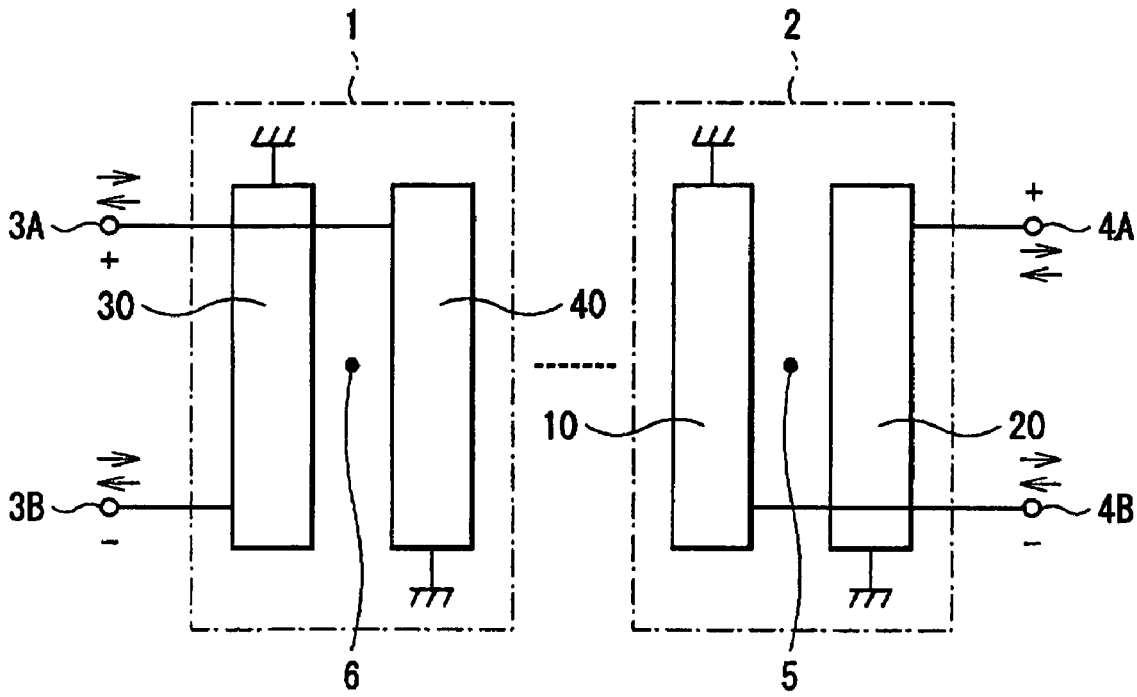
FIG. 22 is a block diagram illustrating an equivalent configuration of a filter according to other preferred embodiment of the present invention.
Figure 23:
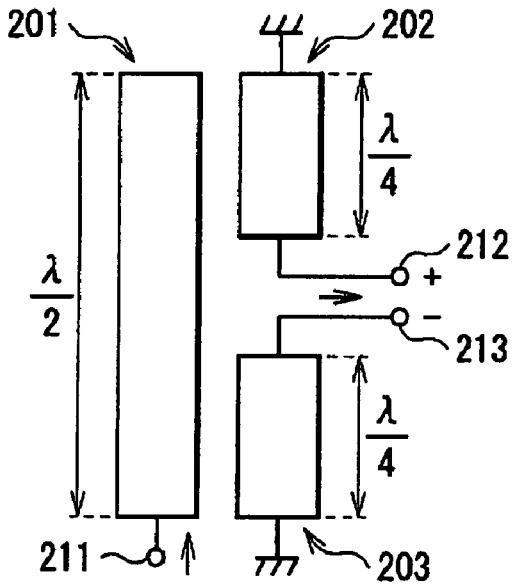
FIG. 23 is a block diagram illustrating a basic structure of a balun of related art.

FIG. 22 illustrates an example of the configuration of the filter of balanced input/balanced output type. This example has the same configuration as the filter according to the third preferred embodiment described with reference to FIGS. 15 and 16, except that a pair of balanced terminals 3A and 3B are connected to the first resonator 1. Like the filter of the third preferred embodiment, this filter is constructed so that the first resonator 1 and the second resonator 2 resonate and establish an electromagnetic coupling at the second resonance frequency $f_2$ which is a lower frequency in the interdigital coupled resonators. This results in a band pass filter of balanced input/balanced output type, employing the second resonance frequency $f_2$ as a passing band. In respect to the filter of balanced input/balanced output type, the configurations as described in the foregoing fourth and fifth preferred embodiments are also applicable.

It should be understood by those skilled in the art that various modifications, combinations, sub-combinations and alterations may occur depending on design requirements and other factors insofar as they are within the scope of the appended claims or the equivalents thereof.

What is claimed is:

1. A stacked resonator comprising;

a pair of quarter-wave resonators which are interdigital-coupled to each other, each of the pair of quarter-wave resonators being constructed of a plurality of conductor lines which are stacked and arranged so as to establish a comb-line coupling, wherein:

the pair of quarter-wave resonators have a first resonance mode in which a resonance at a first resonance frequency $f_1$ higher than a resonance frequency $f_0$ is produced, and a second resonance mode in which a resonance at a second resonance frequency $f_2$ lower than the resonance frequency $f_0$ is produced, where $f_0$ is a resonance frequency in an individual resonator of the pair of quarter-wave resonators when establishing no interdigital-coupling, and an operating frequency is the second resonance frequency $f_2$.

2. The stacked resonator according to claim 1, further comprising;

a pair of balanced terminals, one of the balanced terminals being connected to one of the pair of quarter-wave resonators, the other of the balanced terminals being connected to the other of the pair of quarter-wave resonators.

3. The stacked resonator according to claim 2 wherein, the pair of quarter-wave resonators have, as a whole, a structure of rotation symmetry having an axis of rotation symmetry, and one terminal and the other terminal of the balanced terminals are connected, to the pair of quarter-wave resonators at such positions as to be mutually rotation-symmetric with respect to the axis of rotation symmetry.

4. The stacked resonator according to claim 1, including a plurality of pairs of the quarter-wave resonators, the pairs being stacked and arranged in a direction which is same as a stacking direction of the conductor lines in each quarter-wave resonator so as to oppose to each other, thereby establishing a single stack.

5. The stacked resonator according to claim 4, further comprising at least a pair of balanced terminals wherein, the plurality of pairs of quarter-wave resonators have, as a whole, a structure of rotation symmetry having an axis of rotation symmetry, and one terminal and the other terminal of the balanced terminals are connected to the plurality of pairs of quarter-wave resonators at such positions as to be mutually rotation-symmetric with respect to the axis of rotation symmetry.

6. A filter comprising;

a first resonator having at least a pair of quarter-wave resonators which are interdigital-coupled to each other;

a pair of balanced terminals connected to the first resonator; and a second resonator having at least one pair of quarter-wave resonators which are interdigital-coupled to each other, the second resonator being electromagnetically coupled to the first resonator, wherein:

each of the quarter-wave resonators in the first resonator and the second resonator is constructed of a plurality of conductor lines stacked and arranged so as to establish a comb-line coupling, the each of the quarter-wave resonators in the first resonator have a first resonance mode in which a resonance at a first resonance frequency $f_1$ higher than a resonance frequency $f_0$ is produced, and a second resonance mode in which a resonance at a second resonance frequency $f_2$ lower than the resonance frequency $f_0$ is produced, where $f_0$ is a resonance frequency in an individual resonator of the pair of quarter-wave resonators of the first resonator when establishing no interdigital-coupling, and the first resonator and the second resonator are electromagnetically coupled to each other at the second resonance frequency $f_2$.

7. The filter according to claim 6 wherein, the first resonator has, as a whole, a structure of rotation symmetry having an axis of rotation symmetry, and one terminal and the other terminal of the balanced terminals are connected to the first resonator at such positions as to be mutually rotation-symmetric with respect to the axis of rotation symmetry.

8. The filter according to claim 6 wherein, the first resonator and the second resonator are stacked and arranged in a direction which is same as a stacking direction of the conductor lines in each quarter-wave resonator of the first and second resonators so as to oppose to each other.

9. The filter according to claim 6, further comprising;

a third resonator arranged at a middle stage between the first resonator and the second resonator, the third resonator having at least one pair of quarter-wave resonators which are interdigital-coupled to each other, wherein, each of the quarter-wave resonators in the third resonator is also constructed of a plurality of conductor lines stacked and arranged so as to establish a comb-line coupling.

* * * * *